US006310351B1

(12) United States Patent
Zur

(10) Patent No.: US 6,310,351 B1
(45) Date of Patent: Oct. 30, 2001

(54) X-RAY IMAGING SYSTEM

(75) Inventor: Albert Zur, Ganei Tikva (IL)

(73) Assignee: Edge Medical Devices, Inc., Raanana (IL)

( * ) Notice: Subject to any disclaimer, the term of this patent is extended or adjusted under 35 U.S.C. 154(b) by 0 days.

(21) Appl. No.: 09/233,327

(22) Filed: Jan. 20, 1999

(30) Foreign Application Priority Data

Sep. 1, 1998 (IL) ..... 126018

(51) Int. Cl.[7] ..... G03G 15/00

(52) U.S. Cl. ..... 250/370.09; 250/370.08; 250/580

(58) Field of Search ..... 250/370.09, 370.08, 250/580

(56) References Cited

U.S. PATENT DOCUMENTS

| | | |
|---|---|---|
| 4,079,255 | 3/1978 | Brueckner et al. . |
| 4,176,275 | 11/1979 | Korn et al. . |
| 4,539,591 | 9/1985 | Zermeno et al. . |
| 4,554,453 | 11/1985 | Feigt et al. . |
| 4,961,209 | 10/1990 | Rowlands et al. . |
| 4,975,935 | 12/1990 | Hillen et al. . |
| 4,998,266 | 3/1991 | Hillen et al. . |
| 5,023,455 | 6/1991 | Vanstraelen . |
| 5,059,794 | 10/1991 | Takahashi et al. . |
| 5,077,765 | 12/1991 | Hillen et al. . |
| 5,093,851 | 3/1992 | Schafer . |
| 5,097,493 | 3/1992 | Hillen et al. . |
| 5,117,114 | 5/1992 | Street et al. . |
| 5,153,423 | 10/1992 | Conrads et al. . |
| 5,164,809 | 11/1992 | Street et al. . |
| 5,166,524 | 11/1992 | Lee et al. . |
| 5,184,018 | 2/1993 | Conrads et al. . |
| 5,230,927 | 7/1993 | Nishizawa et al. . |
| 5,268,569 | 12/1993 | Nelson et al. . |
| 5,280,512 | 1/1994 | Maack et al. . |
| 5,332,893 | 7/1994 | Potts et al. . |
| 5,341,409 | 8/1994 | Conrads et al. . |
| 5,354,982 | 10/1994 | Nelson et al. . |
| 5,369,268 | 11/1994 | Van Aller et al. . |
| 5,396,072 | 3/1995 | Schiebel et al. . |
| 5,436,101 | 7/1995 | Fender et al. . |
| 5,440,146 | 8/1995 | Steffen et al. . |
| 5,467,378 | 11/1995 | Lumma et al. . |
| 5,508,507 | 4/1996 | Nelson et al. . |
| 5,510,626 | 4/1996 | Nelson et al. . |
| 5,519,750 | 5/1996 | Heinemann et al. . |
| 5,528,043 | 6/1996 | Spivey et al. . |
| 5,530,238 | 6/1996 | Meulenbrugge et al. . |
| 5,563,421 | 10/1996 | Lee et al. . |
| 5,567,929 | 10/1996 | Ouimette . |
| 5,602,889 | 2/1997 | Oldendorf et al. . |
| 5,652,430 | 7/1997 | Lee . |
| 5,686,732 | 11/1997 | Lumma . |
| 5,723,866 | 3/1998 | Hamilton, Jr. . |
| 5,729,021 | 3/1998 | Brauers et al. . |
| 5,773,839 | 6/1998 | Krepel et al. . |
| 5,812,191 | 9/1998 | Orava et al. . |
| 5,818,052 | 10/1998 | Elabd . |
| 5,818,053 | 10/1998 | Tran . |
| 5,844,243 | 12/1998 | Lee et al. . |

FOREIGN PATENT DOCUMENTS

| | | |
|---|---|---|
| 200 300 | 11/1986 | (EP) . |
| 603 709 A2 | 6/1994 | (EP) . |
| 933 651 A2 | 8/1999 | (EP) . |
| 1 022 586 | 7/2000 | (EP) . |

*Primary Examiner*—Constantine Hannaher
*Assistant Examiner*—Andrew Israel
(74) *Attorney, Agent, or Firm*—Pillsbury Winthrop LLP

(57) ABSTRACT

The present invention discloses an ionizing radiation sensitive multi-layer structure having a charge accepting outer surface and comprising a conductive layer, said ionizing radiation sensitive multi-layer structure being operative such that imagewise ionizing radiation impinging on said ionizing radiation sensitive multi-layer structure causes a charge distribution, representing said imagewise ionizing radiation, to be formed in said conductive layer; and readout electronics coupled to said conductive layer to detect the charge distribution formed in said conductive layer.

48 Claims, 15 Drawing Sheets

X-RAY IMAGING SYSTEM

FIELD OF THE INVENTION

The present invention relates to apparatus and methods for detecting images and more specifically relates to apparatus and methods for digital detection of X-ray images.

BACKGROUND OF THE INVENTION

There are described in the patent literature numerous systems and methods for the recording of X-ray images. Conventional X-ray imaging systems use an X-ray sensitive phosphor screen and a photosensitive film to form visible analog representations of modulated X-ray patterns. The phosphor screen absorbs X-ray radiation and is stimulated to emit visible light. The visible light exposes photosensitive film to form a latent image of the X-ray pattern. The film is then chemically processed to transform the latent image into a visible analog representation of the X-ray pattern.

Recently, there have been proposed systems and methods for detection of X-ray images in which the X-ray image is directly recorded as readable electrical signals, thus obviating the need for film in the imaging process.

For example, U.S. Pat. No. 4,961,209 to Rowlands et al describes a method for employing a transparent sensor electrode positioned over a photoconductive layer and a pulsed laser which scans the photoconductive layer through the transparent sensor electrode.

U.S. Pat. No. 5,268,569 to Nelson et al. describes an imaging system having a photoconductive material which is capable of bearing a latent photostatic image, a plurality of elongate parallel strips adjacent the photoconductive material, and a pixel source of scanning radiation.

U.S. Pat. No. 5,652,430 to Lee describes a radiation detection panel for X-ray imaging systems which is made up of a matrix assembly of radiation detection sensors arrayed in rows and columns to record still or moving images.

Examples of commercially available systems in which X-ray images are directly recorded as readable electrical signals include the Direct Radiography line of detector arrays offered by Sterling Diagnostic Imaging (formerly DuPont) of Delaware, USA; the Pixium line of flat panel X-ray detectors for radiography offered by Trixell of Moirans, France; the Digital Imaging Center offered by Swissray Medical AG of Switzerland; and the Canon Digital Radiography System offered by the Canon Medical Division of Canon U.S.A.

In addition, digital mammographic X-ray systems are commercially available. For example, the Opdima system offered by Siemens Medical Systems, Inc. of New Jersey, USA.

SUMMARY OF THE INVENTION

There is thus provided in accordance with a preferred embodiment of the present invention a radiation detection module including an ionizing radiation sensitive multi-layer structure having a charge accepting outer surface and comprising a conductive layer, the ionizing radiation sensitive multi-layer structure being operative such that imagewise ionizing radiation impinging on the ionizing radiation sensitive multi-layer structure causes a charge distribution, representing the imagewise ionizing radiation, to be formed in the conductive layer, and readout electronics coupled to the conductive layer to detect the charge distribution formed in the conductive layer.

Further in accordance with a preferred embodiment of the present invention the ionizing radiation sensitive multi-layer structure includes a layered stack having layers in the following order: a dielectric layer; the conductive layer; and an ionizing radiation sensitive layer; wherein the charge accepting outer surface is an outer surface of the ionizing radiation sensitive layer.

Still further in accordance with a preferred embodiment of the present invention the ionizing radiation sensitive multi-layer structure includes a layered stack having the following order: a first dielectric layer; the conductive layer; an ionizing radiation sensitive layer; and a second dielectric layer; wherein the charge accepting outer surface is an outer surface of the second dielectric layer.

Moreover in accordance with a preferred embodiment of the present invention the second dielectric layer serves as an optical filter tailoring a radiation spectrum of non-ionizing radiation penetrating into the ionizing radiation sensitive layer.

Further in accordance with a preferred embodiment of the present invention the ionizing radiation sensitive layer is either amorphous selenium or alternatively a selenium alloy.

Additionally in accordance with a preferred embodiment of the present invention, the ionizing radiation sensitive layer is a material selected from the group of lead oxide, thallium bromide, cadmium telluride, cadmium zinc telluride, cadmium sulfide, and mercury iodide.

In yet further accordance with the present invention, the ionizing radiation sensitive multi-layer structure includes a layered stack having the following order: a scintillation layer; a dielectric layer; the conductive layer; and a photoelectric conversion layer, with the charge accepting outer surface being an outer surface of the photoelectric conversion layer and with the conductive layer and the dielectric layer being generally transparent to optical radiation.

Still further in accordance with a preferred embodiment of the present invention, the ionizing radiation sensitive multi-layer structure includes a layered stack having the following order: a scintillation layer; a first dielectric layer; the conductive layer; a photoelectric conversion layer; and a second dielectric layer with the charge accepting outer surface being an outer surface of the second dielectric layer and with the conductive layer and the first dielectric layer being generally transparent to optical radiation.

Moreover, in accordance with a preferred embodiment of the present invention, the second dielectric layer is an optical filter tailoring a radiation spectrum of non-ionizig radiation penetrating into the photoelectric conversion layer.

Additionally, in accordance with a preferred embodiment of the present invention, the photoelectric conversion layer is amorphous selenium, a selenium alloy or amorphous silicon. Alternately, in accordance with a preferred embodiment of the present invention, the photoelectric conversion layer is an organic photoconductor.

Still further in accordance with a preferred embodiment of the present invention, the scintillation layer is cesium iodide or a doped version thereof.

Preferably, the radiation detection module includes a charge injector which scans the outer charge accepting surface of ionizing radiation sensitive multi-layer structure providing injection of charges thereinto, thereby generating in the readout electronics measurable currents which represent the charge distribution formed in the conductive layer.

Yet further in accordance with a preferred embodiment of the present invention, an electrostatic barrier, associated with the charge injector, spatially tailors the charge injection.

Further in accordance with a preferred embodiment of the present invention, the charge injector includes an embedded electrode; an exposed screen electrode in proximity to the embedded electrode, the embedded electrode and the exposed screen electrode being separated at a region of proximity by a thin dielectric layer; a generator that provides an AC voltage between the embedded electrode and the screen electrode causing air discharge at said region of proximity, thus generating positive and negative charges; and a voltage source which provides a DC bias voltage, in the range of several hundreds of volts to several thousands of volts, to the screen electrode, providing the acceleration force for charge injection.

Still in further accordance with a preferred embodiment of the present invention, the DC bias voltage can be selected such that the DC component associated with the Fourier spectrum of spatial frequencies of an image to be detected is factored out.

Moreover, in accordance with a preferred embodiment of the present invention, the measurable currents have an induction component and an injection component.

Additionally in accordance with a preferred embodiment of the present invention, the radiation detection module includes hardware or software which distinguishes between the induction component and the injection component.

Yet further in accordance with a preferred embodiment of the present invention, the readout electronics are permanently coupled to the conductive layer.

In alternate accordance with a preferred embodiment of the present invention, the readout electronics are removably coupled to the conductive layer.

Preferably, the ionizing radiation is x-ray radiation.

There is also provided in accordance with another preferred embodiment of the present invention an addressable array of radiation detection elements including a radiation sensitive layered stack; a plurality of electronically addressable conductive columns associated with the radiation sensitive layered stack; readout electronics coupled to the plurality of electronically addressable conductive columns; and a charge injector, which scans the conductive columns, providing sequential row addressing of the array of radiation detection elements.

In accordance with a preferred embodiment of the present invention, the radiation to be detected by the addressable array of radiation detection elements is ionizing radiation, e.g. x-ray radiation.

Further in accordance with a preferred embodiment of the present invention, the radiation sensitive layered stack includes at least one ionizing radiation sensitive layer.

Still in further accordance with the present invention, the at least one ionizing radiation sensitive layer converts ionizing radiation to charge carriers.

Moreover, in accordance with the present invention, the at least one ionizing radiation sensitive layer converts ionizing radiation to optical radiation.

Additionally in accordance with a preferred embodiment of the present invention, the radiation sensitive layered stack includes a photoelectric conversion layer which converts optical radiation to charge carriers.

Preferably, the at least one ionizing radiation sensitive layer is amorphous selenium or a selenium alloy.

Still in further accordance with the present invention, the at least one ionizing radiation sensitive layer is cesium iodide or a doped version thereof.

Moreover, in accordance with a preferred embodiment of the present invention, the radiation sensitive layered stack includes a charge accepting outer surface.

Additionally in accordance with a preferred embodiment of the present invention the charge accepting outer surface is a dielectric layer which provides optical absorption filtration.

In further accordance with a preferred embodiment of the present invention the readout electronics are permanently coupled to the conductive columns.

Yet in still further accordance with a preferred embodiment of the present invention, the readout electronics are removably coupled to the conductive columns.

There is thus provided in accordance with a preferred embodiment of the present invention, a module for detection of ionizing radiation images, the module including an ionizing radiation receiving substrate arranged to receive an ionizing radiation image, the substrate including at least one layer that is segmented in a single dimension along a single segmentation axis and at least one not segmented layer and also including an elongate scanning charge injector operative in association with the ionizing radiation receiving substrate for scanning the substrate along a scanning axis which is generally perpendicular to the segmentation axis.

There is thus further provided in accordance with a preferred embodiment of the present invention, a method for radiation detection employing an addressable array of radiation detection elements including providing a radiation sensitive layered stack, a plurality of electronically addressable conductive columns associated with the radiation sensitive layered stack and readout electronics coupled to the plurality of electronically addressable conductive columns and employing a charge injector to scan the conductive columns, providing sequential row addressing of the array of radiation detection elements, thereby detecting said radiation via readout electronics.

Further in accordance with a preferred embodiment of the present invention the radiation to be detected by the method for radiation detection employing an addressable array of the radiation detection elements is ionizing radiation, e.g. x-ray radiation.

There is thus provided in accordance with a preferred embodiment of the present invention, a method for radiation detection, the method comprising providing an ionizing radiation sensitive multi-layer structure having a charge accepting outer surface and comprising a conductive layer coupled to readout electronics; sensitizing the ionizing radiation sensitive multi-layer structure; and exposing the sensitized ionizing radiation sensitive multi-layer structure to impinging ionizing radiation, thereby causing a readable charge distribution, representing the impinging ionizing radiation, to be formed in the conductive layer.

Further in accordance with a preferred embodiment of the present invention, the method for radiation detection includes the step of detecting the charge distribution formed in the conductive layer via said readout electronics.

Moreover in accordance with a preferred embodiment of the present invention, the step of detecting the charge distribution includes causing a charge injector to scan over at least part of the charge accepting outer surface.

Reference is made throughout the specification to X-ray radiation, it being understood that the present application is not limited to X-ray radiation, but extends as well to all suitable types of radiation including ionizing radiation, of which X-ray radiation is one example.

BRIEF DESCRIPTION OF THE DRAWINGS

The present invention will be more fully appreciated and understood from the following detailed description, taken in conjunction with the drawings in which.

DETAILED DESCRIPTION OF PREFERRED EMBODIMENTS

Figure 1A:
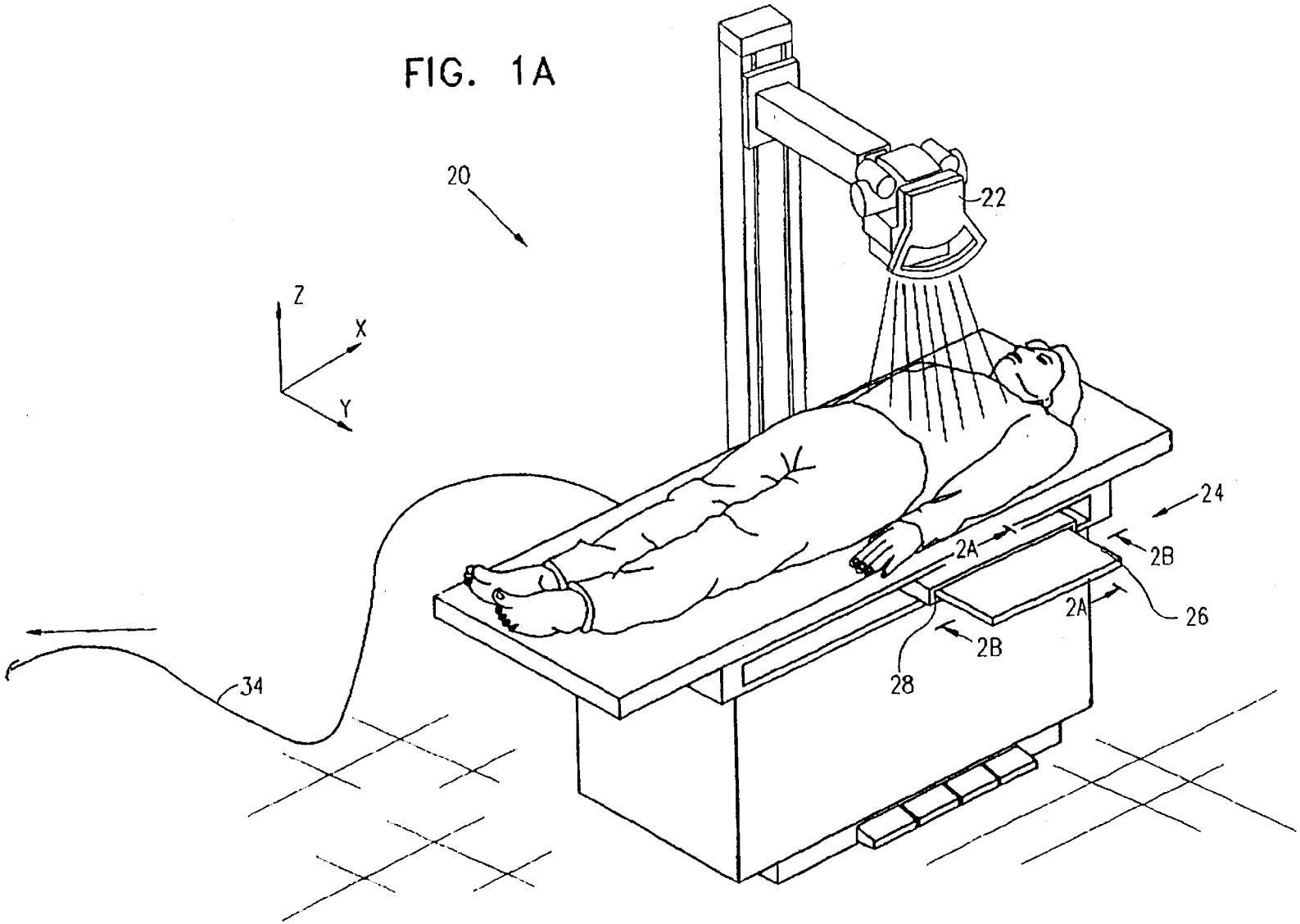
FIGS. 1A and 1B illustrated two alternative embodiments of X-ray imaging systems constructed and operative in accordance with a preferred embodiment of the present invention.
Figure 1B:
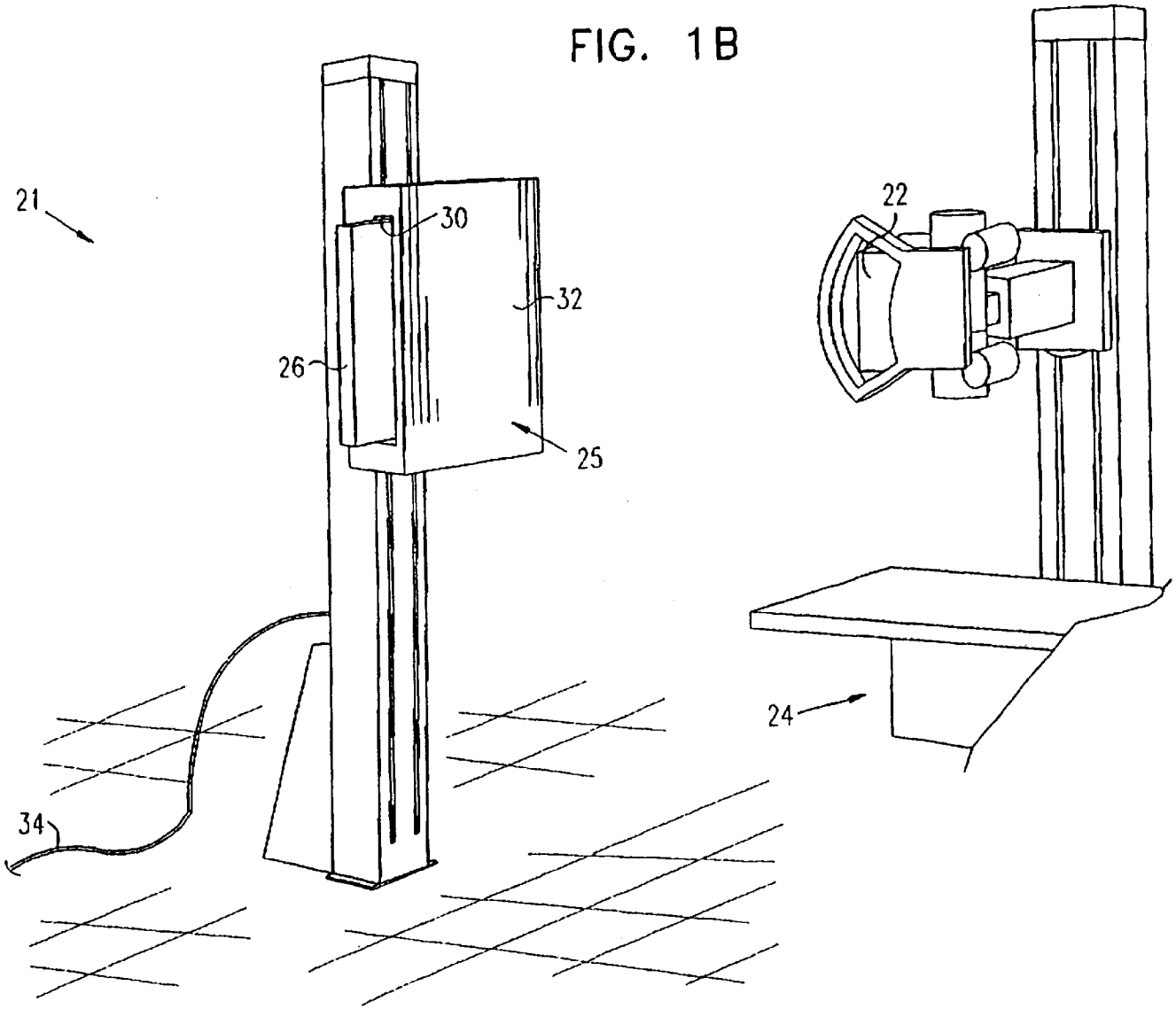

Reference is now made to FIGS. 1A and 1B which illustrate X-ray systems for digital X-ray detection incorporating an Image detection module in accordance with preferred embodiments of the present invention.

FIGS. 1A and 1B illustrate X-ray systems 20 and 21, respectively, which may be of the type sold by, for example, Philips Medical Systems, the Fischer Imaging Corporation, and the Bennett subsidiary of Trex Medical Corporation. X-ray systems 20 and 21 include a source of X-ray radiation 22, an X-ray table 24 (FIG. 1A) and/or a vertical chest stand 25 (FIG. 1B), and further incorporate an Image detection module 26, which obviates the need for a standard film cartridge. It is appreciated that the source of X-ray radiation 22 can be swiveled for use with vertical chest stand 25 as shown in FIG. 1B.

In accordance with one embodiment of the invention, image detection module 26 may be a flat-panel detection assembly, which is insertable into an opening 28 of X-ray table 24 or an opening 30 of a bucky/grid device 32 mounted on vertical chest stand 25. It is appreciated that image detection module 26 may be designed with size dimensions suitable for use with standard mammography systems.

Alternatively, image detection module 26 may form an integrated element of conventional medical/diagnostic X-ray (e.g. bucky devices, X-ray tables, and vertical chest stands) or mammography systems.

During imaging, a patient to be imaged reclines on X-ray table 24 or, alternatively, stands in front of vertical chest stand 25, positioned so that an area of the patient to be imaged lies intermediate the source of X-ray radiation 22 and the image detection module 26. When the source of X-ray radiation 22 is activated, Image detection module "reads" the resulting X-ray image as described herein and outputs an electrical signal representation thereof. The electrical signal representation may be transferred to a display monitor or workstation (not shown) via a communications cable 34 for display, processing, diagnostics, and archiving.

Figure 2A:
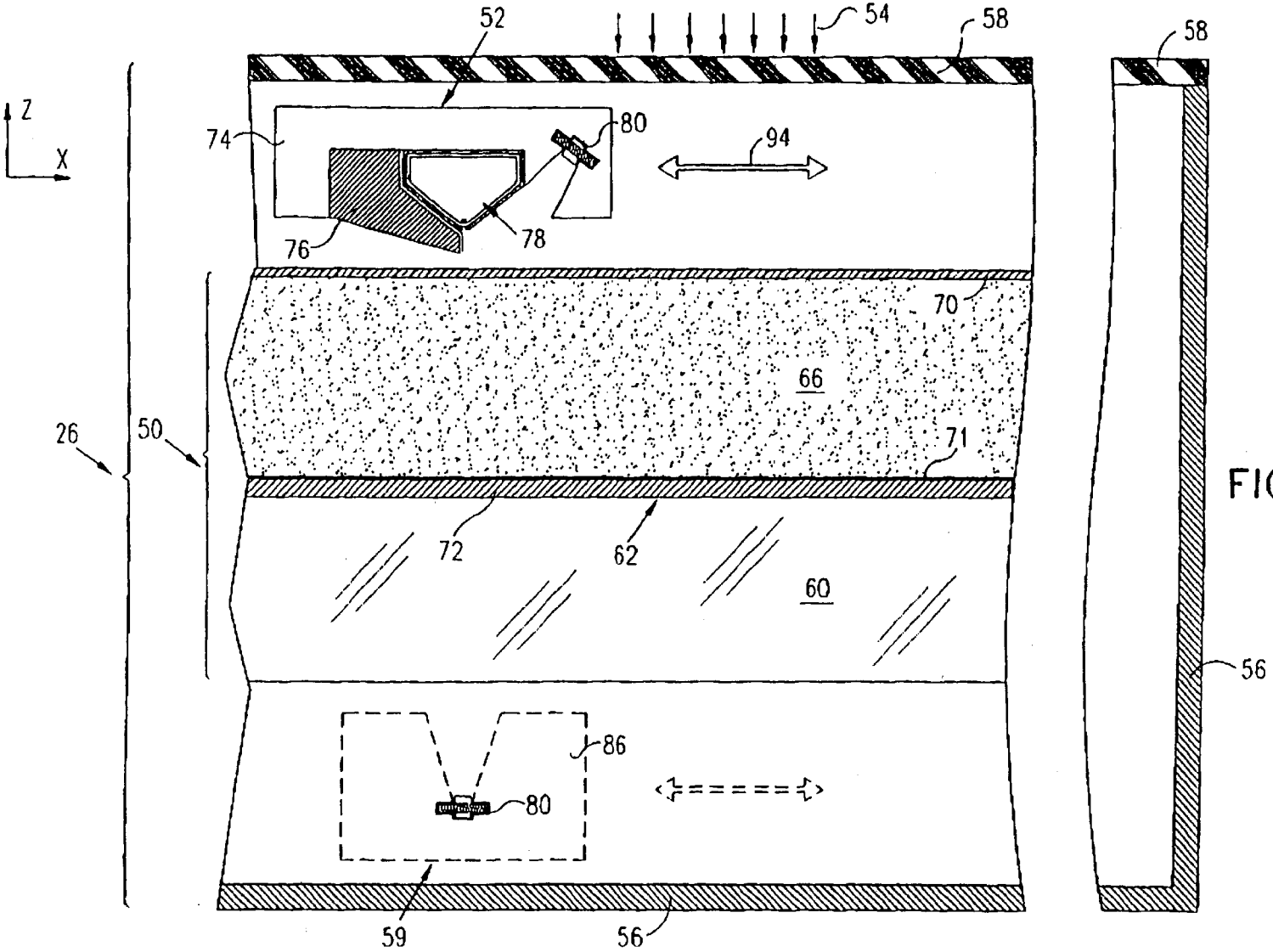
FIGS. 2A and 2B are sectional illustrations taken along lines 2A—2A and 2B—2B respectively of FIG. 1A, illustrating an Image detection module forming part of the systems of FIGS. 1A and 1B.
Figure 2B:
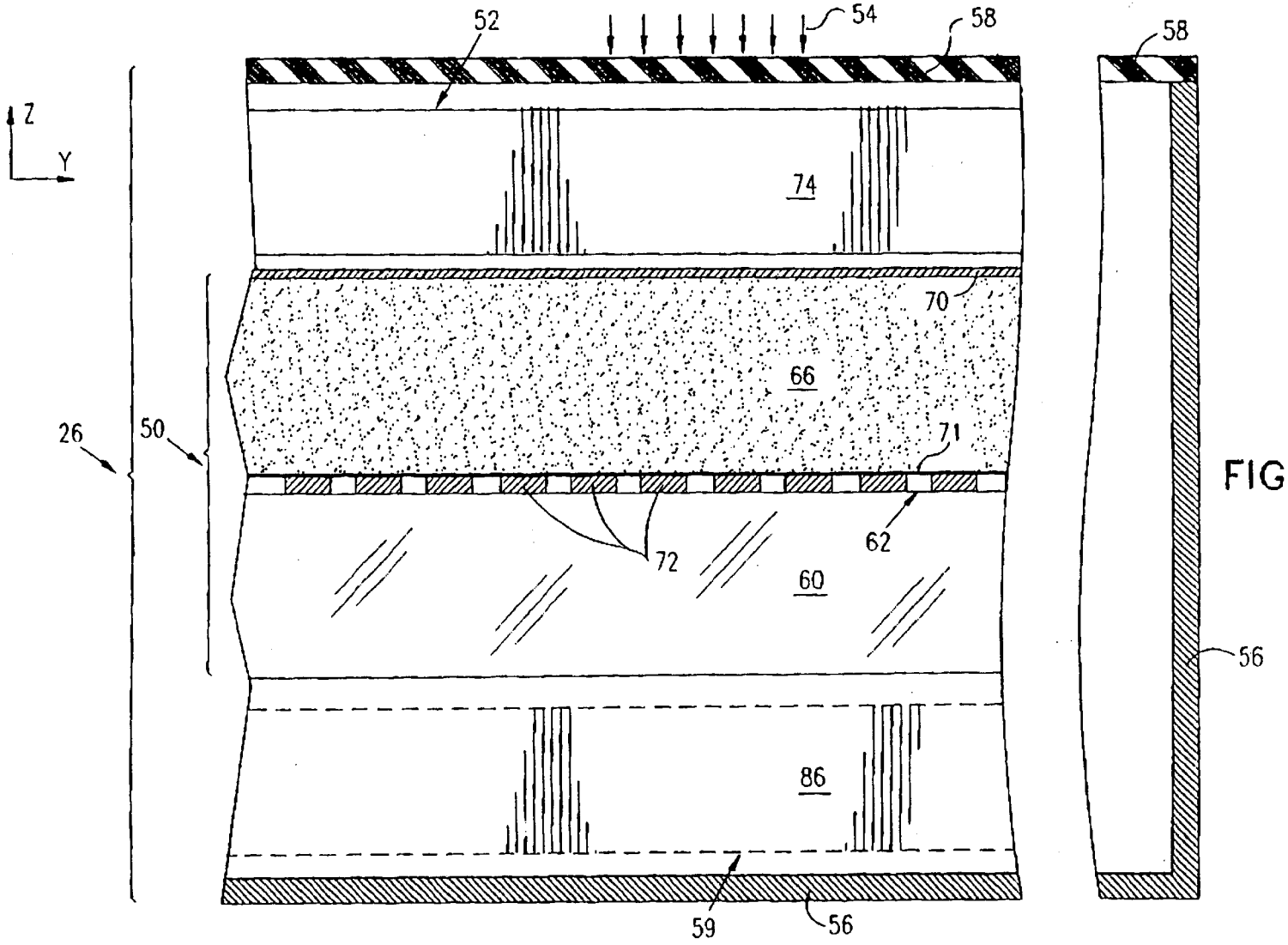

Reference is now made to FIGS. 2A and 2B which are mutually perpendicular cross-sectional views of image detection module 26.

Image detection module 26 includes a detection assembly 50 and an elongate scanner 52. The detection assembly 50, which is exposed to imagewise incident radiation 54 typically representing an X-ray image of a patient, is preferably enclosed by a housing 56 having an upper X-ray permeable cover 58. In accordance with one embodiment of the present invention, detection module 26 may further include an optional lower scanner 59.

Detection assembly 50 preferably comprises a layered stack including a dielectric support substrate 60, a conductive electrode array 62 formed onto and overlying the support substrate 60, an X-ray sensitive layer 66 overlying conductive electrode array 62 and preferably an overlying dielectric layer 70. In accordance with one embodiment of the present invention, a very thin blocking layer 71, typically of sub-micron thickness, is disposed at the interface between the X-ray sensitive layer 66 and the underlying conductive electrode array 62.

Support substrate 60 provides mechanical support and dimensional stability for detection assembly 50 and may serve as a base upon which layers 62–70 are formed. In addition, support substrate 60 provides electrical insulation for conductive electrode array 62. Preferably, support substrate 60 is an optically transparent panel, several millimeters thick (approximately 1 mm–5 mm), having a flat, relatively flawless top surface. Preferably support substrate is formed of glass. Examples of suitable materials for support substrate 60 are Corning glass 7059 and 1737.

In accordance with alternative embodiments of the present invention, support substrate 60 may be an insulative opaque material, e.g. ceramic, or a metallic substrate having a dielectric coating.

Further in accordance with alternative embodiments of the present invention, support substrate 60 and overlying layers 62–70 may be non-planar, e.g. parabolic or cylindrical, to provide alternative detection assembly geometries.

In accordance with a preferred embodiment of the present invention, as seen particularly in FIG. 2B, conductive electrode array 62 comprises a plurality of strip electrodes 72 which are preferably planar, elongate and parallel and which preferably end in fan-out regions (not shown).

Conductive electrode array 62 is preferably formed using photolithography and wet or dry microetching techniques to pattern and segment a generally continuous conductive film which is deposited on a surface of support substrate 60. Alternatively, thermal ablation techniques (e.g. laser "dry", etching) can be used for patterning and segmentation of the conductive film.

The conductive film is preferably a thin metallic coating, e.g. aluminum or gold, which is typically deposited on support substrate 60 using conventional deposition techniques, e.g. vapor deposition, sputtering, etc., to provide a uniform layer which is typically 1000–10,000 angstroms thick.

Alternatively, the conductive film may be indium tin oxide (ITO) which is also transparent to visible radiation.

The pitch between adjacent strip electrodes 72 of conductive electrode array 62 determines the resolution of detection assembly 50 in one direction.

For example, resolutions of 10–20 lines per millimeter can be achieved using strip electrodes 72 having a pitch of 100–50 microns, respectively. Preferably, the width of each strip electrode 72 is two to four times greater than the gap between adjacent electrodes.

Figure 11:
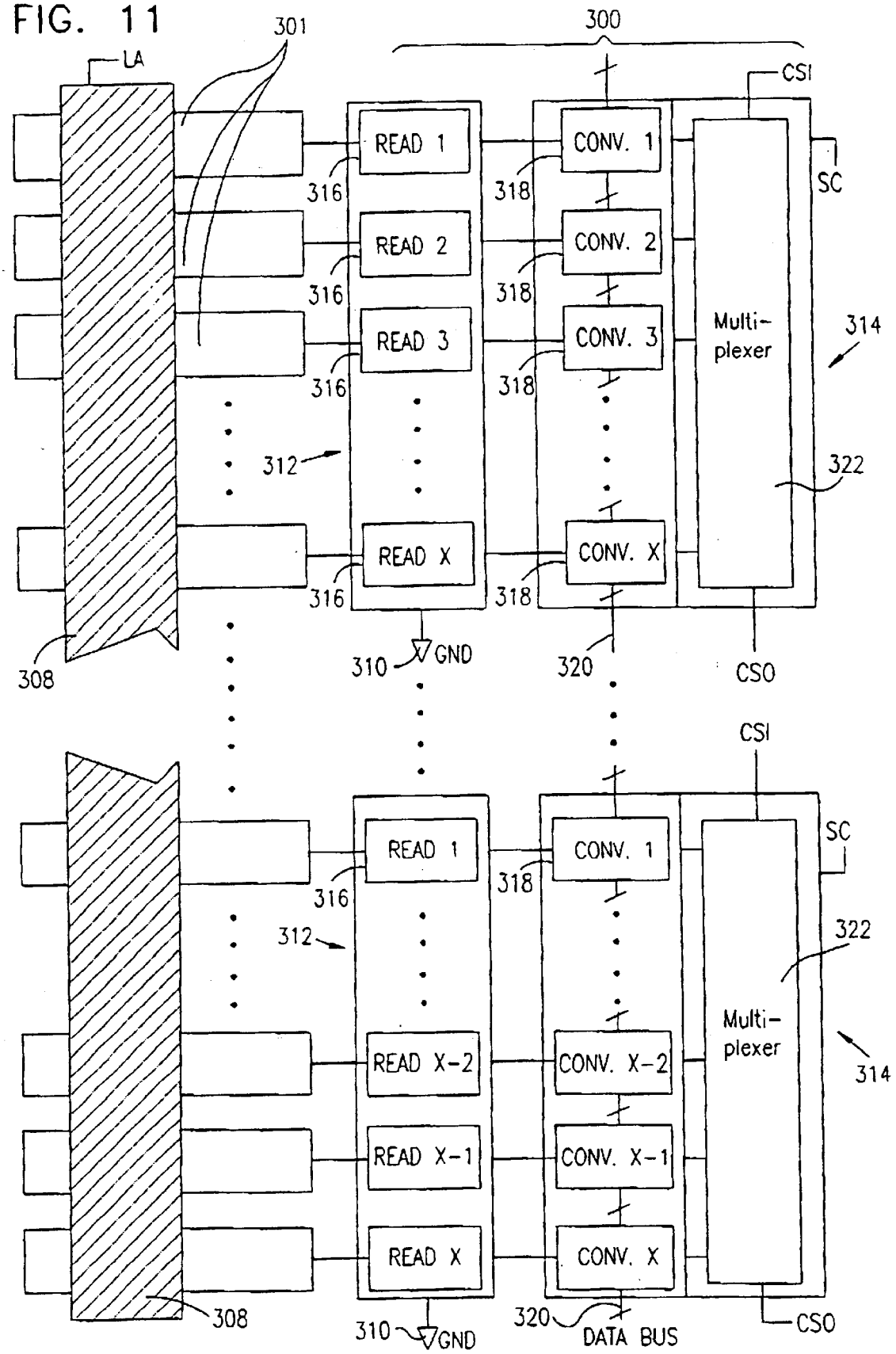
FIG. 11 is a simplified illustration of read-out electronics employed in the image detection module of FIGS. 1A–9C in accordance with one embodiment of the present invention.
Figure 12:
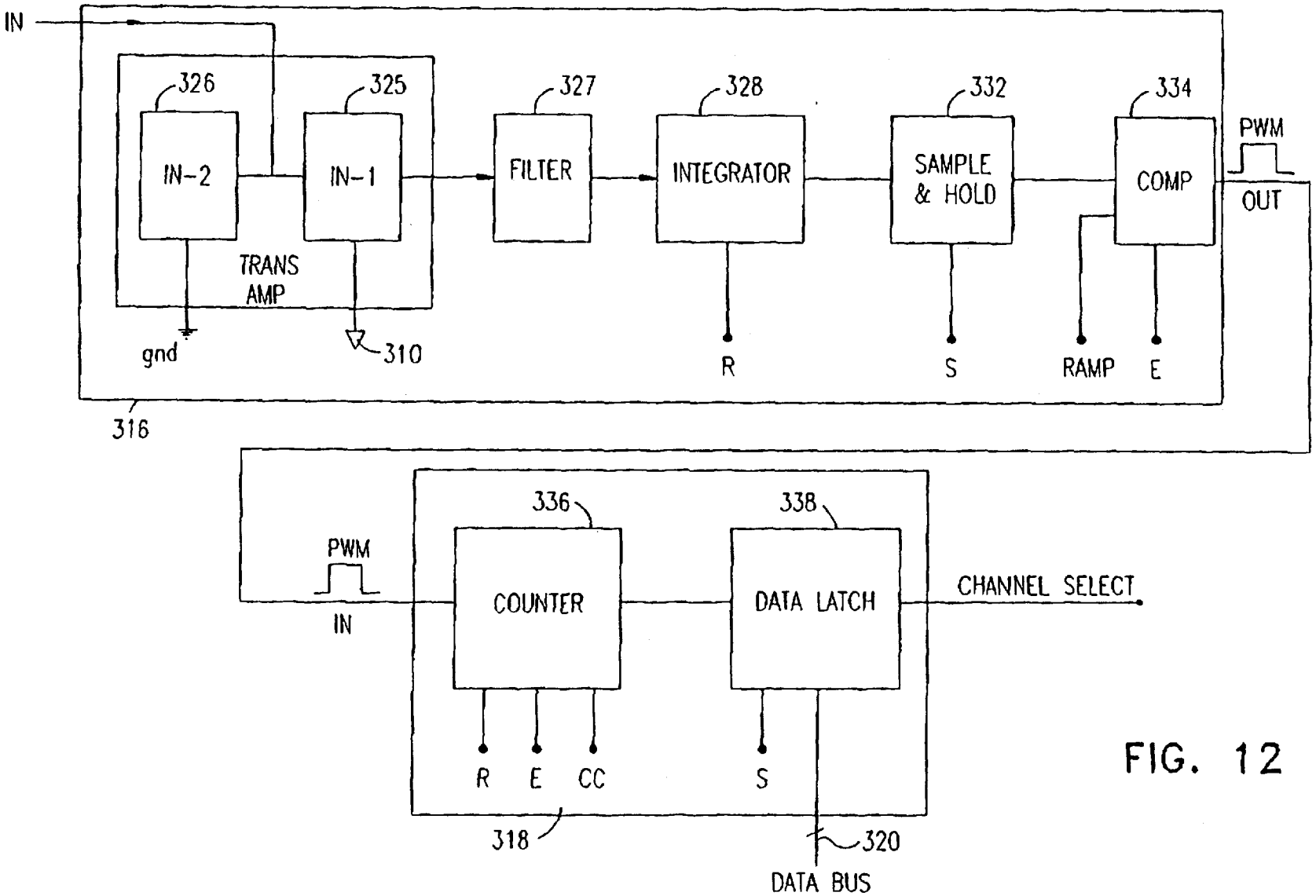
FIG. 12 is a block diagram illustration of portions of the apparatus of FIG. 11.
Figure 13:
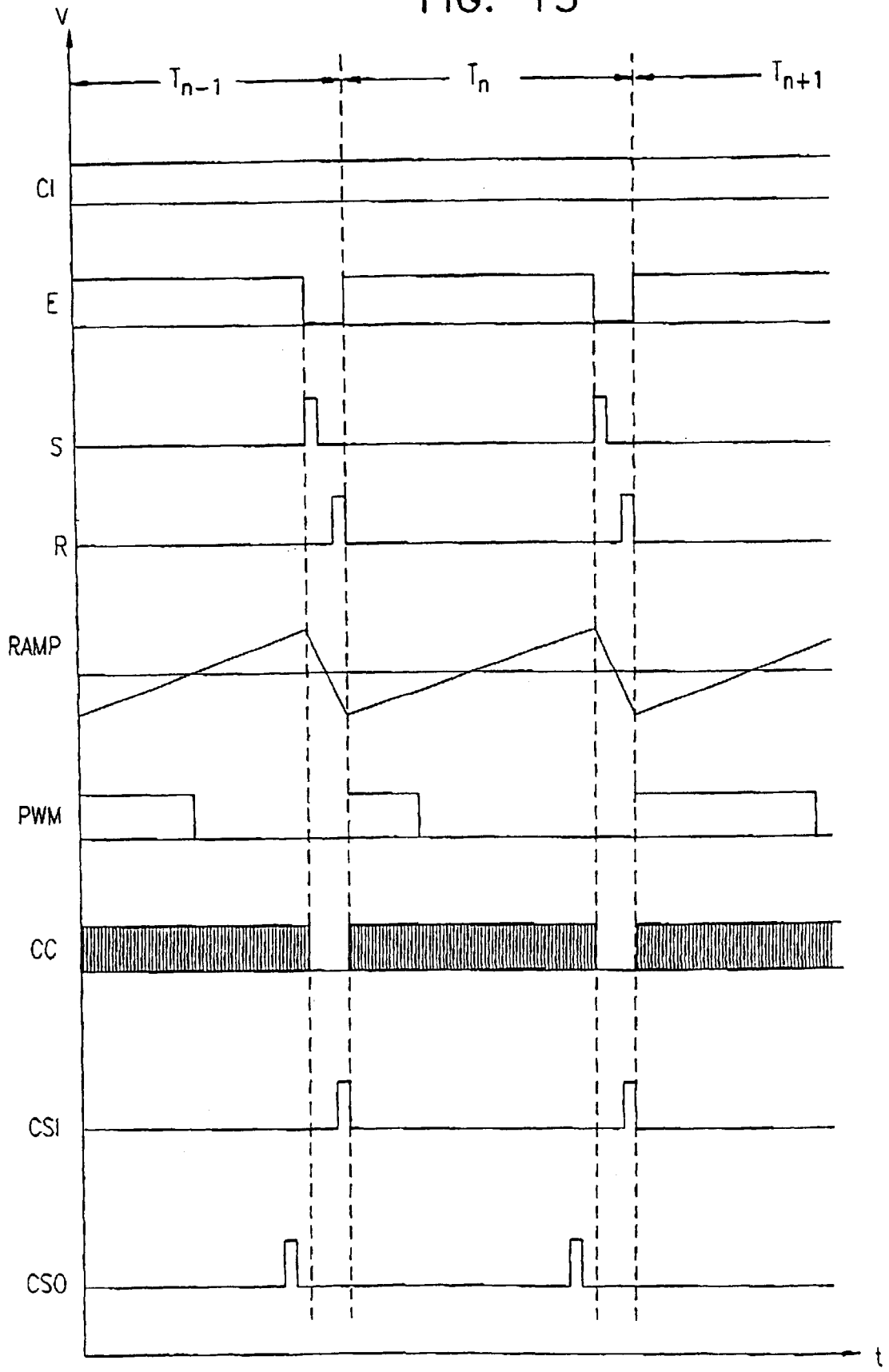
FIG. 13 is a timing diagram useful in understanding of the operation of the readout electronics of X-ray detection module of FIGS. 1A–12.

Typically, readout electronics, which are described hereinbelow with reference to FIGS. 11–13, are preferably fixed or removably connected to connection fan-out regions (not shown) of conductive electrode array 62. The connection regions, which may be at one or more non-active locations of detection assembly 50, are provided in order to enable use of standard electronic connection technologies associated with chip-on-glass or flip-chip technologies. For removable high density connections, zebra silicon rubber connectors are preferable. Preferably, non-active locations are located at the periphery of detection assembly 50.

Preferably and depending upon the conductive electrode material, the very thin blocking layer 71, mentioned above, which overlies and electrically insulates conductive electrode array 62, preferably fills the gaps between adjacent strip electrodes 72. The very thin blocking layer 71, which may be silicon monoxide (SiO), silicon dioxide ($SiO_2$), a combination thereof or other suitable materials, is preferably deposited on conductive electrode array 62 using conventional vacuum deposition techniques.

X-ray sensitive layer 66, which preferably overlies the thin blocking layer 71 over conductive electrode array 62, preferably exhibits properties which make it suitable to serve as an X-ray imaging material. For example, following exposure to incident X-ray photons, the material generates a suitable number of extractable free electron hole pairs. In addition, X-ray sensitive layer 66 preferably exhibits generally high dark resistivity, allowing an electric field to be maintained thereacross for a period of time required for X-ray exposure and reading. Furthermore, the density of charge carrier trap sites in X-ray sensitive layer 66 is preferably low.

X-ray sensitive layer 66 may comprise, for example, amorphous selenium, selenium alloys, lead oxide, thallium bromide, cadmium telluride, cadmium zinc telluride, cadmium sulfide, mercury iodide or any other material that exhibits X-ray sensitivity and stopping power in the radiation spectrum of interest.

Typically for medical imaging applications the X-ray photon energy spectrum ranges from 18 keV (mammography) to 150 keV (general radiography). Preferably, the thickness of X-ray sensitive layer 66 is sufficient to allow absorption of approximately 50% or more of the flux of the incident X-ray radiation 54 as further described hereinbelow. For example, when using amorphous selenium or selenium alloys, the layer thickness required to achieve at least 50% absorption ranges from approximately 30 microns (at 18 keV) to 600 microns (at 150 keV).

Dielectric layer 70 is preferably highly uniform with a thickness in the range of 0 (no layer) to several tens of microns. Preferably, the thickness of dielectric layer 70 is several microns. Dielectric layer 70 may act as a charge accepting layer, as an optical filter, as a passivation layer or as a combination thereof.

The material properties desirable for dielectric layer 70 include volume resistivity which is greater than $10^{13}$ ohms/centimeter, high dielectric strength (preferably higher than 50 volts/micron). In addition, dielectric layer 70 may serve as an optical filter which absorbs a selected radiation spectrum, e.g. undesired UV and visible radiation, preventing penetration of said radiation into X-ray sensitive layer 66. Dielectric layer 70 may further serve as a physical and/or chemical passivation layer for X-ray sensitive layer 66.

When amorphous selenium is used for X-ray sensitive layer 66, examples of a suitable material for dielectric layer 70 are polymers such as poly-para-xylylenes which may be applied as a conformal coating in a room-temperature vacuum coating operation.

FIGS. 2A and 2B also show elongate scanner 52 which preferably includes an electrically insulating housing assembly 74, an electrostatic barrier 76, and a charge injector 78.

An elongate light source 80 as described hereinbelow may be contained within elongate scanner 52. In accordance with an alternate embodiment of the present invention, particularly when dielectric layer 70 has optical filtering properties, elongate light source 80 may be positioned below support substrate 60 in an enclosure assembly 86 as part of optional lower scanner 59.

Preferably, elongate light source 80 includes a linear array of individual light emitting diodes (LEDs) arranged in an elongate array as described hereinbelow with reference to FIGS. 5 and 6.

Figure 6:
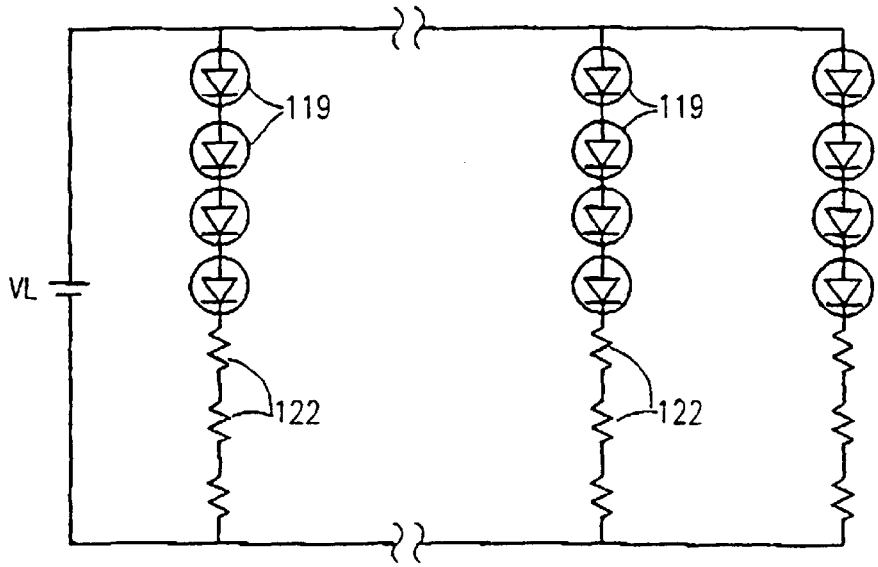
FIG. 6 is a simplified electrical circuit diagram of a power supply for the light source of FIG. 5.

The LEDs of elongate light source 80 are collectively driven by an external power source as shown in FIG. 6.

When X-ray sensitive layer 66 is amorphous selenium or a selenium alloy, elongate light source 80 preferably emits blue light with a peak wavelength of approximately 470 nanometers. Examples of suitable blue light emitting LEDs are Indium gallium-nitride/Gallium-nitride/Silicon carbide blue LEDs of the types available from Hewlett-Packard, Nichia Chemical Industries, Ltd. or Cree Research.

Alternatively, elongate light source 80 may comprise white light emitting LEDs. An example of suitable white light emitting LEDs are those available from Nichia Chemical Industries Ltd., which combine blue LEDs and phosphor technology. In accordance with an alternative embodiment of the present invention, elongate light source 80 may comprise a combination of blue and white LEDs.

Typically, elongate scanner 52 is capable of sweeping back and forth in the x-direction along an axis 94 across conductive electrode array 62 using conventional electro-mechanical means (not shown) to provide linear motion thereof along conventional linear guides (not shown). In accordance with an alternate embodiment of the present invention, linear motion of optional lower scanner 59 uses the same electro-mechanical means (not shown).

In the z-direction, the spacing between elongate scanner 52 and detection assembly 50 is generally fixed at a predetermined distance which is typically 0.1 mm–0.3 mm. When elongate light source 80 is positioned below support substrate 60, the spacing between the optional lower scanner 59 and the detection assembly 50 is typically in the range of 0.1 mm–1 mm the precise spacing being non-critical.

Preferably, and in order to achieve a fairly compact and generally flat image detection module 26 (FIGS. 1A and 1B), the z-dimensions of elongate scanner 52 and optional lower scanner 59 are fairly small, e.g. 5–10 mm.

Figure 3A:
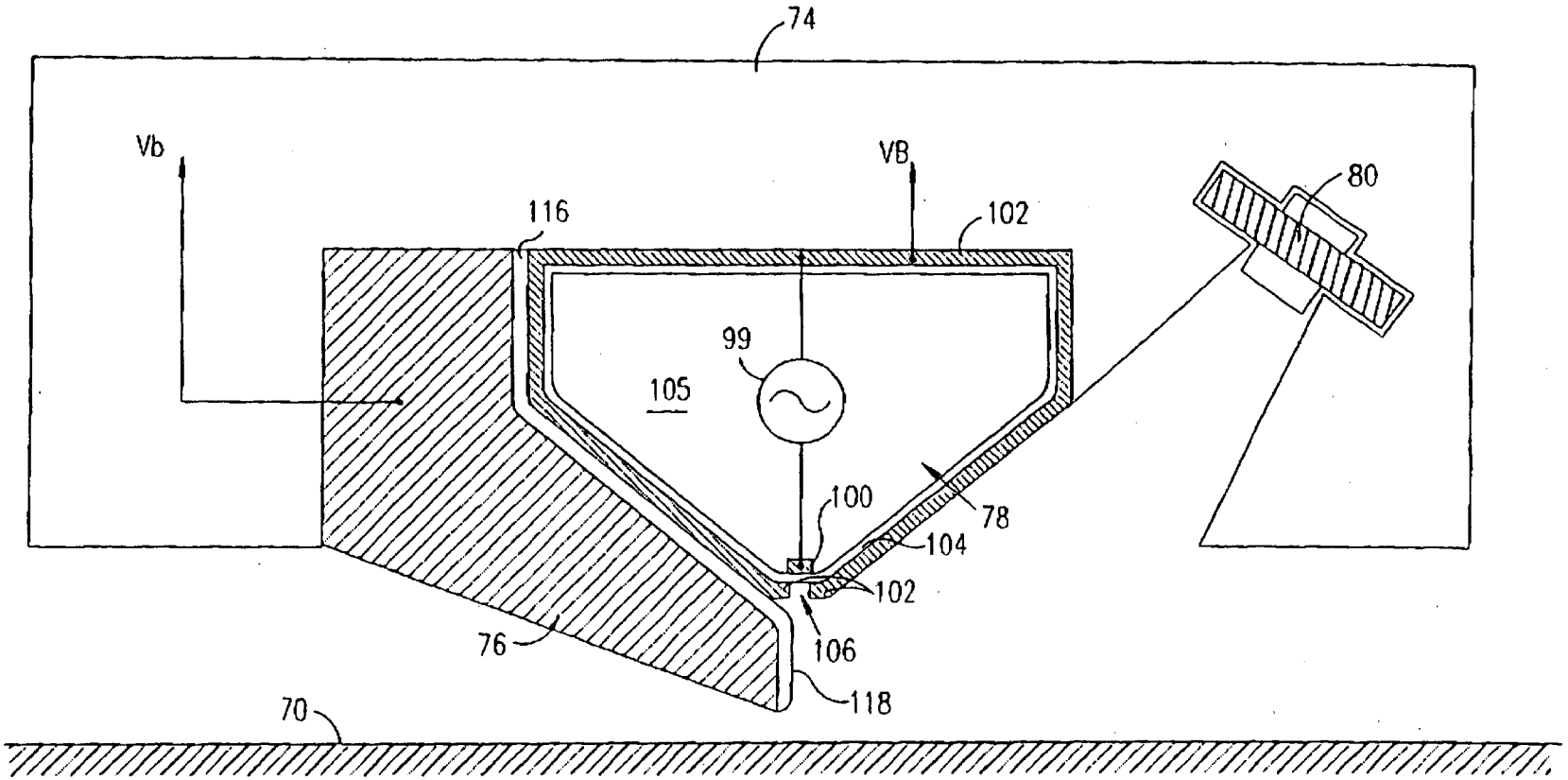
FIGS. 3A and 3B are simplified cross-sectional illustrations of an elongate scanner of the Image detection module of FIGS. 2A and 2B.
Figure 3B:
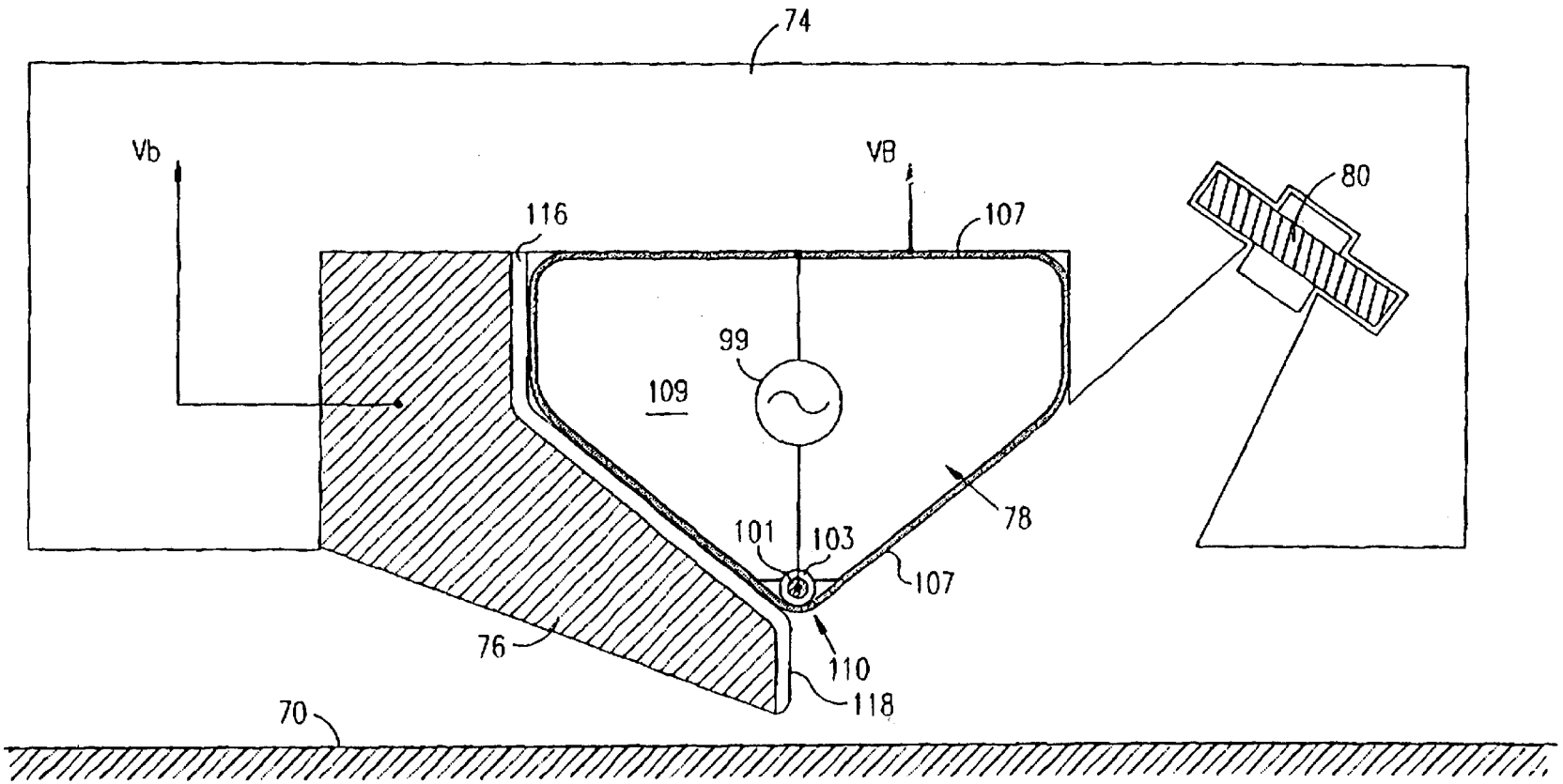

Reference is now made to FIGS. 3A and 3B which illustrate two alternative non-limiting embodiments of the elongate scanner 52 of FIGS. 2A and 2B in accordance with preferred embodiments of the present invention.

For the sake of simplicity, detection assembly 50 is not shown in its entirety in FIGS. 3A and 3B and only dielectric layer 70 is shown.

In accordance with an alternate embodiment of the present invention, an outer surface of X-ray sensitive layer 66 (FIG. 2A) serves as a charge accepting surface instead of dielectric layer 70, thus obviating the need for dielectric layer 70.

As noted above, elongate scanner 52 typically includes an electrically insulating housing assembly 74, an electrostatic barrier 76, and a charge injector 78. In addition, elongate scanner 52 may contain elongate light source 80.

Charge injector 78 generates positive and negative charges which are preferably injected onto dielectric layer 70 as follows:

An AC voltage which typically is of the order of 2000–2, 500 volts peak-to-peak and having a frequency of between several tens of kilohertz to a few megahertz, is applied by a voltage source 99 across an embedded elongate electrode 100 and an exposed screen electrode 102 which are separated at their region of closest proximity by a thin dielectric layer 104. Exposed screen electrode 102 typically includes one or more elongate conductive electrodes.

Thin dielectric layer 104, which may be any suitable dielectric material, such as silicon dioxide, is typically several tens of microns thick.

An inner dielectric support 105, which is preferably glass or ceramic, defines the geometry of and supports elongate screen electrode 102 as well as embedded elongate electrode 100.

The relationship between and the geometry of embedded elongate electrode 100, exposed screen electrode 102 and thin dielectric layer 104 determine the capacitance and therefore the electrical impedance of charge injector 78 which is driven by the AC voltage source 99.

The AC voltage applied across embedded elongate electrode 100 and exposed screen electrode 102 is selected to produce an AC electric field sufficiently strong to cause air discharge at exposed regions of thin dielectric 104 which are in proximity to said electrodes. Such a region in the above embodiment is an elongate discharge region 106 where discharge results in the generation of a relatively large quantity of positive and negative charges, a fraction of which may then be extracted and injected.

FIG. 3B describes an alternate embodiment of charge injector 78 (FIG. 2A) in which an embedded electrode 101 having a thin dielectric layer 103 is preferably a thin conductive wire having a glass coating. An exposed screen electrode 107 may be formed of another thin conductive wire having a thickness of several tens of microns. The thin conductive wire is preferably wound into generally spaced coils over an inner dielectric support 109, which may be a glass or ceramic rod, and over the embedded electrode 101 and its thin dielectric layer 103, as shown in FIG. 3B.

An elongate discharge site 110 is defined by the regions where exposed screen electrode 107 intersects the embedded electrode 101 and its thin dielectric layer 103.

In both the embodiments of FIGS. 3A and 3B, charges (positive or negative) are preferably injected from the discharge site onto dielectric layer 70 by injection forces created when a bias voltage VB is applied between the exposed screen electrode and the conductive electrode array 62 (FIGS. 2A and 2B). Typically bias voltage VB is a DC voltage in the range of 0–5000 volts.

Preferably, and in order to effectively allow the injection of the thus generated charges into dielectric layer 70 to be controlled by bias voltage VB, the exposed screen electrode is configured to electrostatically shield the embedded electrode having the AC voltage applied thereto from dielectric layer 70 and the underlying layers (FIG. 2A) of detection assembly 50.

Typically, charge injection from charge injector 78 onto dielectric layer 70 is self-quenching. Space charges created by the accumulation of charge on dielectric layer 70 progressively reduce the injection forces to a generally negligible value. Thus, the controlling factor in determining the polarity and density of charge accumulated on dielectric layer 70 is the amplitude and polarity of bias voltage VB.

Because the injection can include charges of either polarity, an initial or residual charge on dielectric layer 70 does not generally influence the final accumulated charge density. Instead, the final accumulated charge density (i.e. the apparent surface voltage) is determined by bias voltage VB.

Electrostatic barrier 76 is preferably biased to a DC potential of Vb which is equal to VB, but mutually insulated therefrom. Use of two mutually insulated biasing potentials, VB and Vb, allows differentiation between current that is a result of the injection of charges described hereinabove and current that results from induction of charges during image reading as described hereinbelow.

Figure 4:
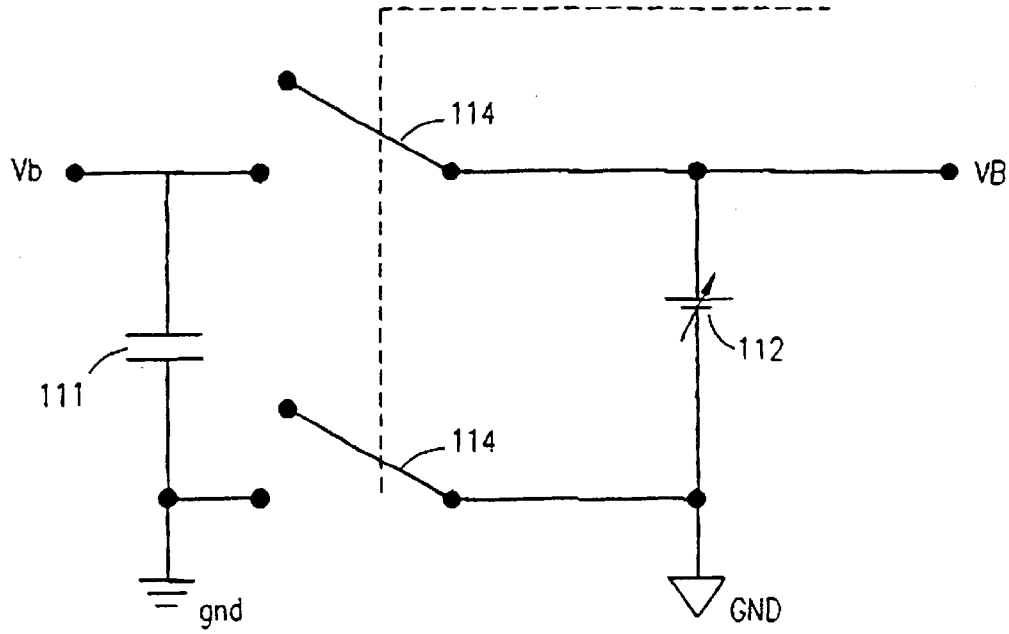
FIG. 4 is a simplified electrical circuit diagram of a biasing system in accordance with a preferred embodiment of the present invention.

Biasing of electrostatic barrier 76 and the exposed screen electrode to the same potential may be carried out by the electrical circuitry illustrated in FIG. 4. The circuitry of FIG. 4 is intended as a non-limiting example; other suitable circuitry may be employed.

As shown in FIG. 4, a stored energy capacitor 111 is charged to a value VB by a voltage source 112. As discussed hereinbelow, at the relevant time during a reading cycle a relay 114 is triggered to electrically disconnect stored energy capacitor 111 from voltage source 112, yielding two mutually insulated sources having equal bias potentials VB and Vb, each source being connected to a separate ground GND and gnd, respectively.

Referring once again to FIGS. 3A and 3B, charge injection onto dielectric layer 70 is spatially tailored by electrostatic barrier 76, which is typically an elongate conductive barrier having a thin dielectric outer coating 116. Thin dielectric outer coating 116 electrically insulates electrostatic barrier 76 from the exposed screen electrode.

Preferably, an elongate edge 118 of electrostatic barrier 76, which transverses conductive electrode array 62 (FIG. 2A), tailors the electric field in the region adjacent thereto.

By tailoring the electric field, elongate edge 118 directs the flow of injected charges to the dielectric layer 70 and prevents charge flow at regions on the dielectric layer 70 beyond elongate edge 118.

Preferably, elongate edge 118 is in non-contact proximity with dielectric layer 70, with a typical gap of 0.1–0.3 mm.

Insulating housing assembly 74, which is preferably made of a suitable plastic or other material, electrically insulates charge injector 78 and electrostatic barrier 76 from its surroundings. Typically elongate light source 80, which is capable of projecting light onto dielectric layer 70, is embedded in insulating housing assembly 74. As illustrated in FIGS. 3A and 3B, elongate light source 80 is preferably oriented such that projected light impinges upon dielectric layer 70 in regions which may receive injected charges.

Figure 5:
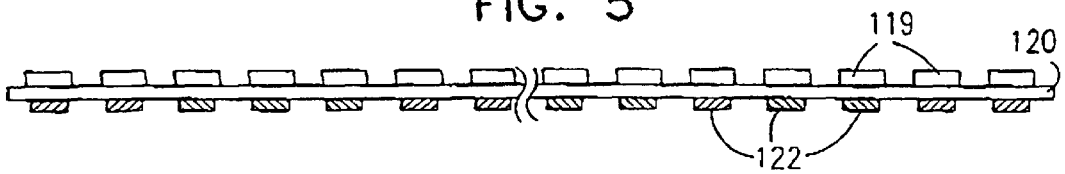
FIG. 5 is a simplified cross-sectional illustration taken along lines 2A—2A of an elongate light source constructed and operative in accordance with a preferred embodiment of the present invention.

Reference is now made to FIG. 5 which illustrates a cross section of one preferred embodiment of elongate light source 80 in accordance with the present invention.

Elongate light source 80 preferably includes a plurality of light emitting diode chips (LEDs) 119 which are arranged in an elongate array and are preferably surface mounted to one side of a rigid printed circuit board (PCB) 120. Preferably, a plurality of resistors 122, which control the current and thus LED brightness flowing through the LEDs 119, are surface mounted on the opposite side of PCB 120.

Preferably, the LEDs are selected such that the spectrum emitted is coincident with the sensitivity of the x-ray sensitive layer. For example, when selenium is used for x-ray sensitive layer 66 (FIGS. 2A–2B), LEDs 119 may emit blue light or white light or a combination thereof as described hereinabove.

Preferably, elongate light source 80 is geometrically suitable for into insulating housing assembly 74. Alternatively, elongate light source 80 may be housed in enclosure assembly 86 (FIG. 2A) of optional lower scanner 59.

It is appreciated that the example described herein provides one non-limiting embodiment of elongate light source 80 and that alternative light sources, e.g. an aperture fluorescent lamp are possible.

Reference is now made to FIG. 6, which is an electrical circuit diagram illustrating an embodiment of a power supply circuit for illuminating the array of LEDs 119 mounted on PCB 120. Preferably, LEDs 119 are driven by a single DC voltage source VL which is typically on the order of several tens of volts.

Preferably, LEDs 119 are divided into parallel-connected groups. Within each group, the LEDs 119 are serially connected to one or more current-limiting resistors 122. It is appreciated that the use of more resistors allows better heat dissipation to the area surrounding the LEDs 119.

Reference is now to made to FIGS. 7A–7D which illustrate the operation of a detection assembly 150 constructed and operative in accordance with a preferred embodiment of the present invention, which may serve as detection assembly 50 in the embodiments of FIGS. 2A–6.

Figure 7A:
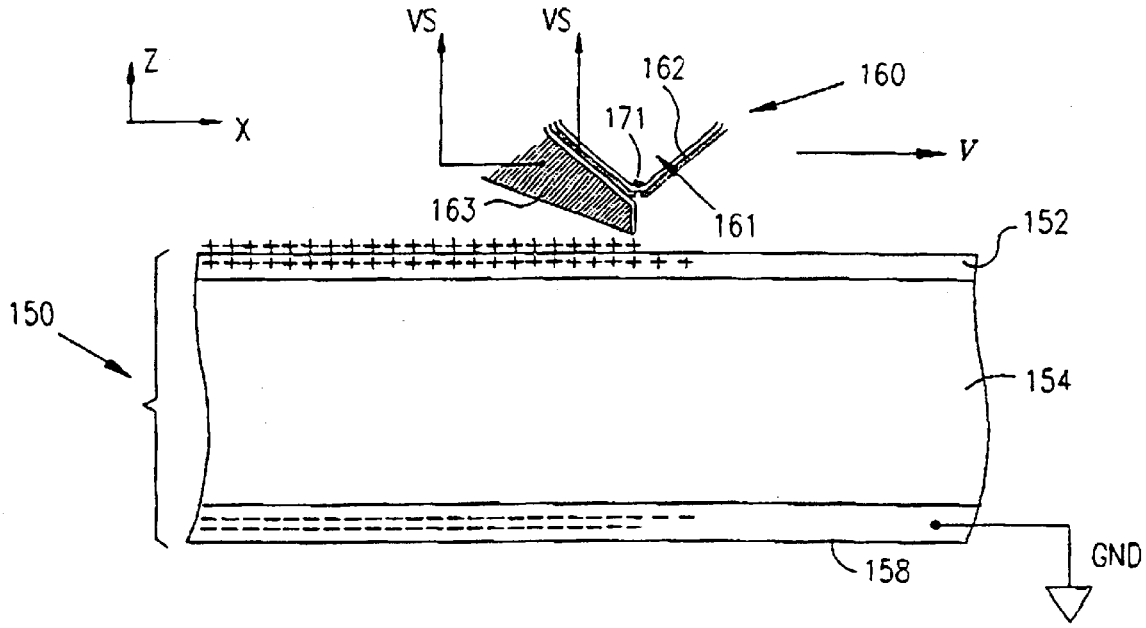
FIGS. 7A, 7B, 7C, and 7D are simplified illustrations showing operation of the image detection module of FIGS. 2A–6.
Figure 7B:
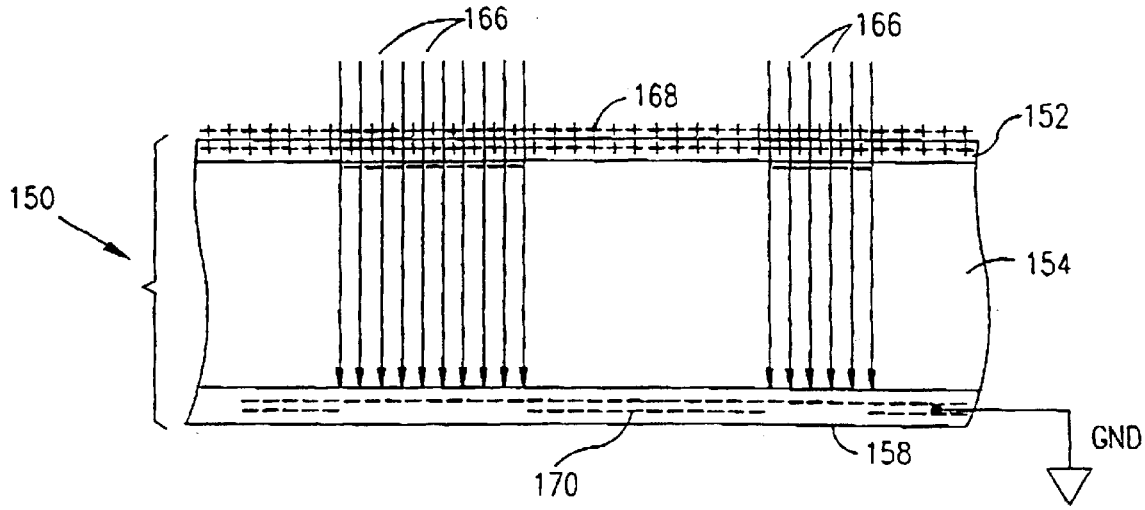
Figure 7C:
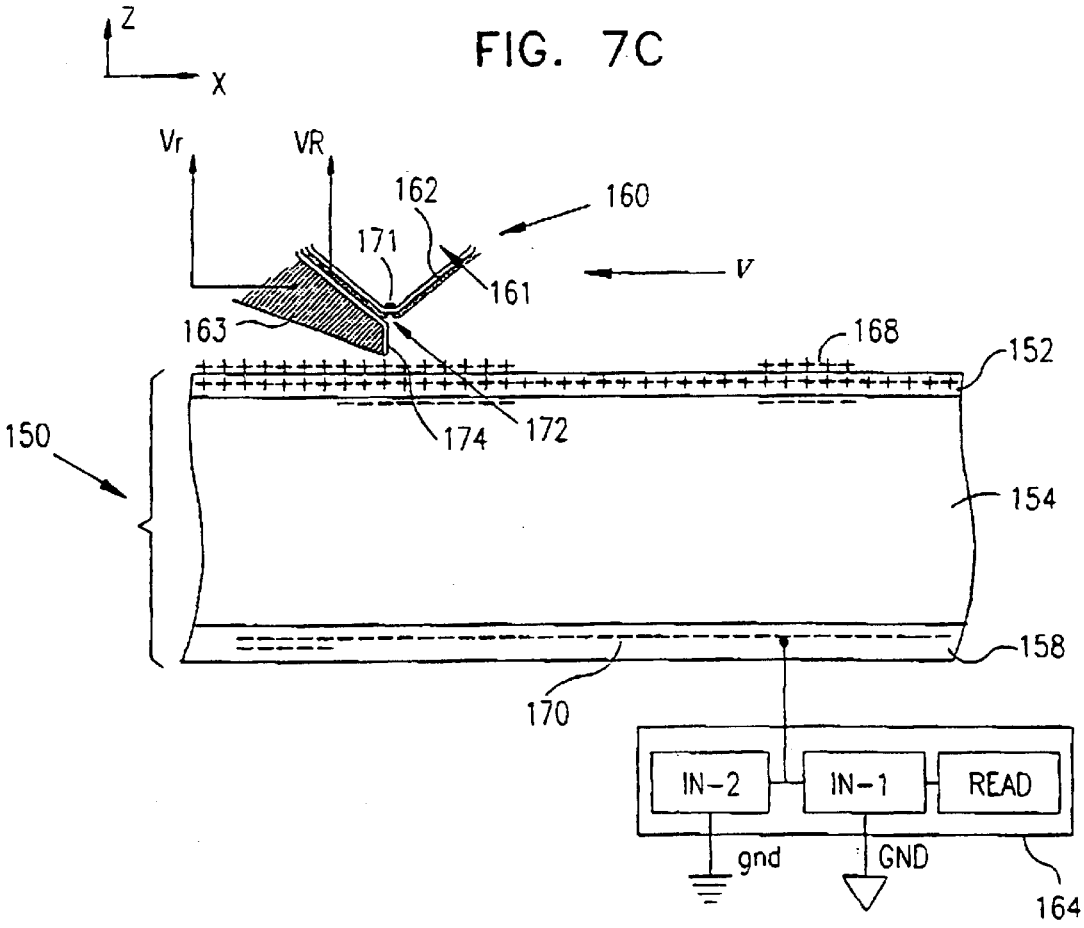
Figure 7D:
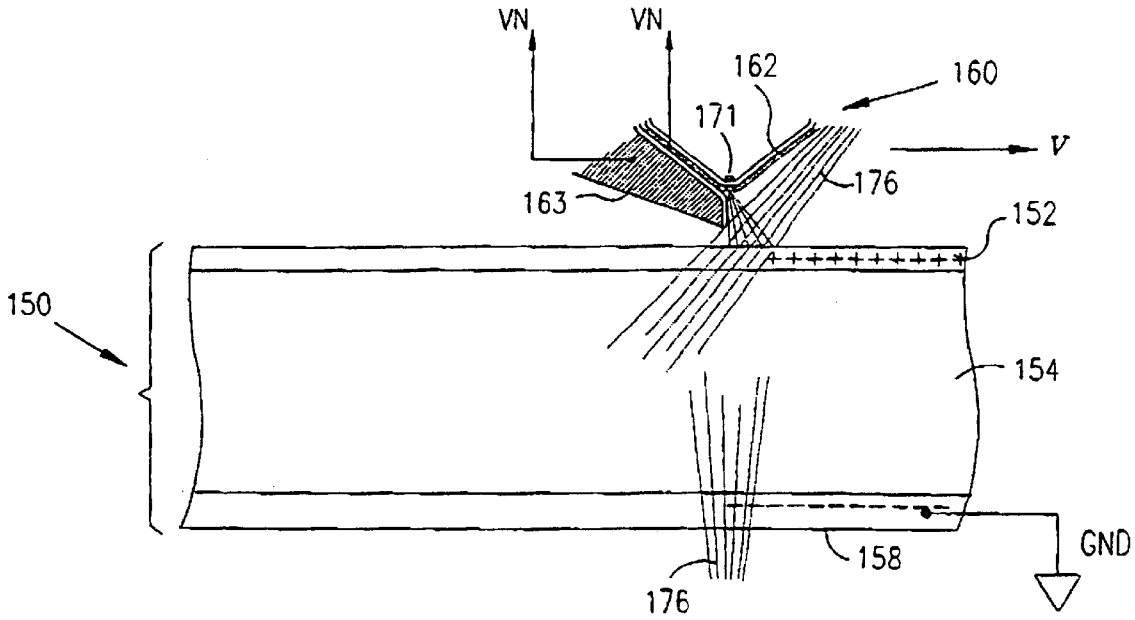
Figure 8:
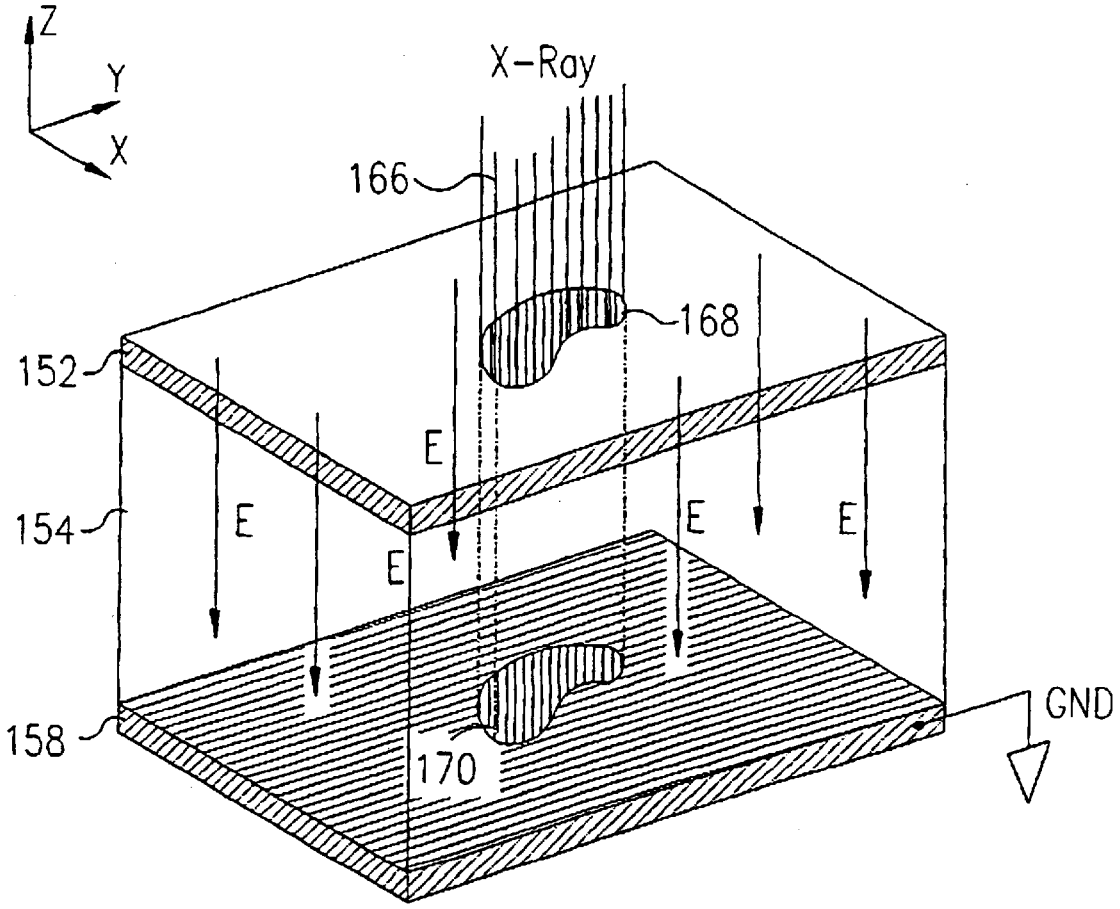
FIG. 8 is a three-dimensional visualization of charge image replication in accordance with a preferred embodiment of the present invention.

Reference is also made to FIG. 8, which is useful in understanding the operation of the Image detection module as illustrated in FIGS. 7A–7D.

Detection assembly 150 preferably comprises a dielectric layer 152, an X-ray sensitive layer 154 underlying the dielectric layer, a very thin blocking layer (not shown) underlying the X-ray sensitive layer 154, and a conductive electrode array 158 preferably comprising a plurality of elongate strip electrodes (not shown). Detection assembly 150 further includes an optically transparent support layer (not shown) and an elongate scanner 160 (partially illustrated) and may also comprise optional lower scanner (not shown) as described hereinabove.

For the purpose of the discussion to follow, conductive electrode array 158 can be considered, electrostatically, as being a continuous electrode, inasmuch as the gaps between the strip electrodes thereof are typically below the overall operating resolution of detection assembly 150.

Elongate scanner 160 sweeps over dielectric layer 152 using conventional mechanical means (not shown). During the sweep, dielectric layer 152 is uniformly charged by charge injection to a first apparent surface voltage when a charge injector 161 is activated as described hereinbelow, thus creating an electric field across X-ray sensitive layer 154.

The first apparent surface voltage is determined by a sensitizing bias voltage VS applied to exposed screen electrode 162 and to electrostatic barrier 163 relative to a ground potential GND applied to conductive electrode array 158 through readout electronics 164 (FIG. 7C). The charge injector 161 and the exposed screen electrode 162 and their related elements may be constructed and operative in accordance with the embodiments of either of FIGS. 3A and 3B or alternatively any other suitable embodiment.

Readout electronics 164 may be constructed and operative as described hereinbelow with respect to the embodiments of FIGS. 11–13.

Preferably, when the X-ray sensitive layer 154 is an amorphous selenium or selenium based alloy, characterized in that its charge acceptance is greater for positive charging, sensitizing bias voltage VS is positive, yielding a generally uniform distribution of positive charges on dielectric layer 152 as shown in FIG. 7A.

Typically, the value of VS which is selected in order to create a high, but sustainable, electric field across X-ray sensitive layer 154, is on the order of several hundreds to several thousand volts, with the exact value depending on the thickness of X-ray sensitive layer 154. If X-ray sensitive layer 154 is amorphous selenium or a selenium-based alloy, the desired field strength is preferably in the range of 5–20 volts/micron.

Creation of an electric field within X-ray sensitive layer 154 causes sensitization of the X-ray sensitive material in preparation for exposure to X-ray radiation, with a higher field strength providing increased sensitivity to X-ray radiation. Preferably, sensitization is carried out immediately prior to X-ray exposure as described hereinbelow.

FIG. 7B illustrates the exposure of detection assembly 150 to X-ray imaging radiation 166. X-ray imaging radiation 166 is partially absorbed by X-ray sensitive layer 154, with the absorbed radiation representing a transmission modulated X-ray image of an object, such as a region of the human body.

Radiation photons, which are by nature more energetic than the band gap of the X-ray sensitive material, create free electron/hole pairs in X-ray sensitive layer 154 in accordance with an image-wise pattern. The electric field present across X-ray sensitive layer 154, causes the electron/hole pairs to separate, creating free charge carriers of different polarities which move in opposing directions along electric field lines which are perpendicular to the plane of X-ray sensitive layer 154.

Since net positive charges are retained on dielectric layer 152 in the example shown, following exposure and corresponding generation of free positive and negative charge carriers in X-ray sensitive layer 154, negative charge carriers move towards dielectric layer 152. This causes imagewise reduction of the net charge at the top of X-ray sensitive layer 154 thereby creating a net charge pattern 168, which corresponds to the transmission modulated image represented by X-ray imaging radiation 166.

Similarly, positive charge carriers move to conductive electrode array 158 where they are sinked to or sourced from GND.

X-ray exposure and creation of the net charge pattern 168, yields patterning of the previously uniform apparent surface voltage (ASV) on dielectric layer 152. Thus, the electric field across X-ray sensitive layer 154, which field extends normally to detection assembly 150, is no longer uniform. Instead the electric field is weakened and reduced from its initial value in an image-wise manner. The field strength at any location is weakened in proportion to the amount of radiation absorbed thereby, yielding a spatially distributed electric field pattern over X-ray sensitive layer 154.

As long as the electric field across X-ray sensitive layer 154 remains sufficiently strong, space charge effects are negligible and charge carrier transit is along straight field lines normal to the plane of X-ray sensitive layer 154, with virtually no sideways displacement (lateral spread) of charge which could cause blurring or scattering and a corresponding reduction of image resolution.

In order to maintain high resolution as well as high sensitivity to X-ray exposure, typically, the maximum reduction of the strength of any local electrical field (corresponding to maximum X-ray exposure) across X-ray sensitive layer 154 should preferably not exceed approximately one-third of the initial field strength.

It is appreciated that the one-third reduction of the local electrical field is considered to be a general guideline.

It may be appreciated from the foregoing discussion that, to maintain high resolution and X-ray sensitivity, the maximum dose of X-ray imaging radiation 166 preferably does not exceed the dose which reduces the local electrical field across X-ray sensitive layer 154 to two-thirds of its initial value. For very thick x-ray sensitive layers (~500 microns), reducing the local electrical field by more than one half may cause degradation of the image resolution and the X-ray sensitivity.

Moreover, the abovementioned characteristics of the field across X-ray sensitive layer 154 which allow high spatial resolution and high X-ray sensitivity to be maintained during X-ray exposure, also cause an imagewise charge redistribution within conductive electrode array 158. This redistribution yields a spatial charge replica 170 in array 158 which tracks and replicates the net charge pattern 168 at the top of X-ray sensitive layer 154 as shown in FIGS. 7B and 8. As a result, spatial charge replica 170 also represents the transmission modulated image of X-ray imaging radiation 166.

After the exposure step and prior to commencement of reading, bias voltage VS is reduced to a new value VR As described hereinabove with reference to FIG. 4, a relay is triggered to mutually insulate exposed screen electrode 162 and electrostatic barrier 163, having respective bias voltages VR which is relative to GND and Vr, which is relative to gnd. Preferably the amplitudes of VR and Vr are equal and are selected as described hereinbelow.

A charge injector 161 of elongate scanner 160 is activated when an AC voltage is applied between the embedded electrode 171 and the exposed screen electrode 162 as described hereinabove. The AC voltage may be applied in bursts or continuously.

FIG. 7C illustrates the reading of an X-ray image detected via detection assembly 150 by sequential line-by-line uniformization of raster lines of the net charge pattern 168 using elongate scanner 160.

Images are read as elongate scanner 160 sweeps across detection assembly 150 at a velocity v in the direction shown in FIG. 7C in synchronization with the operation of readout electronics 164. Velocity v is determined by the operation of the electro-mechanical means (not shown) which drive elongate scanner 160. During the sweep, self-quenched charge injection from charge injector 161 to dielectric layer 152 occurs along an elongate edge 174 of electrostatic barrier 163.

During its sweep, the charge injector 161 may be activated in bursts in accordance with the read sampling frequency as described hereinbelow in connection with FIGS. 11 and 13. Alternatively, charge injector 161 may be continuously activated during reading, independently of the read sampling frequency. In accordance with either embodiment, the read "steps" as defined by the read sampling frequency determine the width of each raster line of the image being read.

With each read "step" of elongate scanner 160, a new line of net charge pattern 168 along elongate edge 174 of electrostatic barrier 163 is uniformized.

Uniformization occurs through self-quenching charge injection which yields a uniform ASV on dielectric layer 152, which ASV generally corresponds to VR. At regions on dielectric layer 152 which are beyond elongate edge 174, the electrostatic barrier 163 tailors the electric fields to shield the ASV and to generally prevent charge flow from the charge injector 161 to those regions.

Thus, at regions beyond elongate edge 174, the ASV maintains imagewise patterning in accordance with the X-ray image information.

Figure 9A:
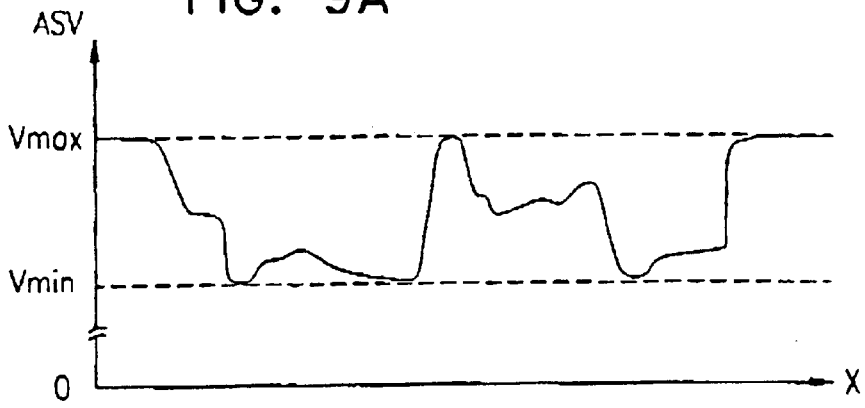
FIGS. 9A, 9B and 9C are voltage diagrams useful in understanding of the operation of the Image detection module as illustrated in FIGS. 7A–8.
Figure 9B:
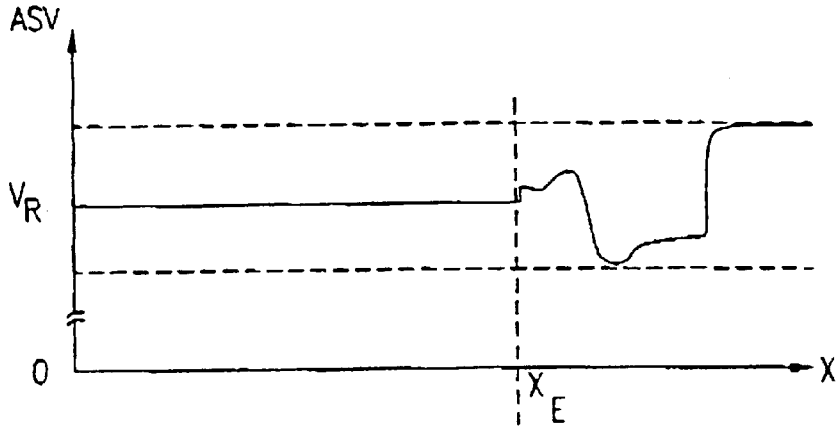
Figure 9C:
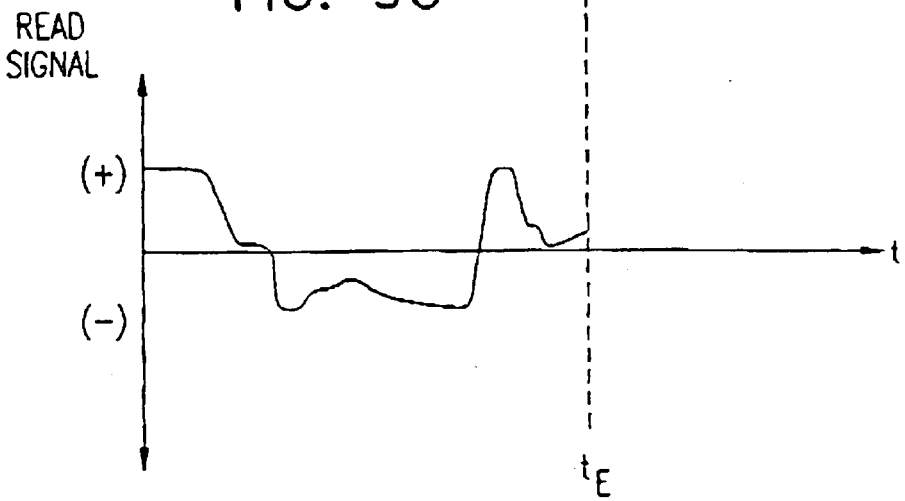

The operation of the apparatus described in FIGS. 7A–7D may be further understood by referring to the diagrams of FIGS. 9A, 9B and 9C.

FIG. 9A is a diagram illustrating the ASV on dielectric layer 152 following X-ray exposure. Regions with minimum exposure to X-ray radiation, such as regions of maximum radiation absorption by the corresponding area of the object being imaged, retain a maximum ASV $V_{MAX}$. Accordingly, regions which receive maximum X-ray exposure, such as regions of minimum radiation absorption by the corresponding area of the object being imaged reduce the ASV to a min value $V_{MIN}$.

As shown in FIG. 9B, during reading of an X-ray image, the reading bias voltage VR is preferably selected such that $VR=(V_{MAX}-V_{MIN})/2$. Areas behind elongate edge 174 of elongate scanner 160 during its sweep, corresponding to areas on the diagram to the left of reference mark $X_E$, have undergone a uniformization of the ASV. Regions to the right of $X_E$ are located beyond the elongate edge 174 and have therefore maintained their ASV pattern, generated following the exposure step (FIG. 7B).

FIG. 9C is a timing diagram illustrating the signal read by readout electronics 164 where time $t_E$ is the elapsed time from the start of the sweep to the time at which the elongate edge 174 of elongate scanner 160 reaches position $X_E$. By selecting VR as described hereinabove, the read signal has both positive and negative values.

Selecting the value of VR to be at the midlevel between $V_{MIN}$ and $V_{MAX}$ offers an advantage which is a particular feature of the present invention, namely, the capability to factor out the DC component of the Fourier spectrum of any image at the level of the radiation sensor, before the signal is read using readout electronics 164. This enables efficient use of the dynamic range of readout electronics 164.

Moreover, selecting VR to be at the midlevel also minimizes the maximum potential difference between the electrostatic barrier 163 and the local ASV on the dielectric layer 152, thus minimizing possible disturbances of the ASV pattern from electrical breakdown discharge (Paschen's Law) in the air gap between electrostatic barrier 163 and dielectric layer 152.

It is appreciated that, during reading (FIG. 7C), the region on dielectric layer 152 exposed to charge injection in the x-direction is greater than the width of one raster line and may comprise many raster lines. However, regions at which net charge pattern 168 has been made uniform generally do not undergo further changes in charge distribution, due to the self-quenching nature of the charge injection. Thus, spatial charge replica 170 undergoes line-by-line uniformization yielding line by line charge redistribution in accordance with the sweep of elongate scanner 160.

Line-by-line redistribution of spatial charge replica 170 causes a flow of measurable currents in conductive electrode array 158, associated with each new line of the X-ray image being read.

The current flowing due to charge redistribution in each electrode of conductive electrode array 158 is generally composed of two components. The first component is the injection current, which is associated with charge injection onto dielectric layer 152 and which is the signal to be measured. The second component is the induction current, which is associated with capacitive charge induction caused by the sweep of the biased electrostatic barrier 163 over the net charge pattern 168 of detection assembly 150.

To read the X-ray image, it is preferable to distinguish between the two currents and to measure the injection current only.

One hardware-based mechanism, given here as a non-limiting example, which enables separation of the injection and induction currents is the mutual electrical isolation between electrostatic barrier 163 and exposed screen electrode 162. This isolation allows the injection current to be sinked or sourced through a first input stage of readout electronics 164 from GND, while the induction current is sinked or sourced through a second input stage of readout electronics 164 from gnd.

A second non-limiting example of distinguishing between the induction and injection currents is a software based method by which each image is read by two sequential scans of elongate scanner 160. During the first read scan, the same bias VR is applied both to electrostatic barrier 163 and exposed screen electrode 162 using only one reference ground GND. Since charge injector 161 is not activated during the first scan, readout electronics 164 reads the induction current only. Moreover, the ASV image is maintained across dielectric layer 152 and is not affected by the first read scan.

During the second read scan, charge injector 161 is activated while the same bias VR is applied both to electrostatic barrier 163 and exposed screen electrode 162. During the second scan, readout electronics 164 reads a combined current comprising both the injection and induction currents.

After both scans, software processing can be carried out on the data from the two different scans, yielding data which is associated only with the injection current, thus separating between the injection and induction currents.

Injection currents are preferably measured by readout electronics 164 as described hereinbelow, thus reading spatial charge replica 170 and providing an electrical signal representation of the transmission modulated image represented by X-ray imaging radiation 166. Since entire raster lines are read in parallel by readout electronics 164, very high speed frame reading can be accomplished in a matter of several seconds or less.

Provided that the electric field is maintained as described herein, reading resolution, and thus imaging pixels, are adjustable in the x-direction by selecting the read "step" size, with the minimum pixel being determined by the charge injection profile tailored by elongate edge 174 of electrostatic barrier 163. Typical read resolution is approximately 5–10 line pairs per millimeter.

In the transverse direction (y-direction), provided that the electric field is maintained as described herein, reading resolution, and thus pixel size, are adjustable electronically, with the minimum pixel size being determined by the pitch of conductive strips in conductive electrode array 158 as described herein.

Upon the completion of reading as described herein, detection assembly 150 may be prepared for subsequent X-ray imaging cycles by repeating the steps of sensitizing, exposing and reading shown in FIGS. 7A–7C.

Alternatively, as shown in FIG. 7D, the charge on dielectric layer 152 may be effectively neutralized prior to sensitizing.

The net charge on dielectric layer 152 is typically neutralized by activating charge injector 161, applying a bias Voltage VN and sweeping elongate scanner 160 across detection assembly 150. VN is typically in the range of between about 0 volts down to minus several hundred volts. Following sweeping, the ASV is neutralized or effectively reduced to a generally very low value relative to GND.

Alternately, charges on dielectric layer 152 and within releasable traps in X-ray sensitive layer 154 may be neutralized by activating elongate light source 80 (FIG. 2A) which projects an elongate light beam 176.

Elongate light beam 176 is generally absorbed by and creates free charge carriers in X-ray sensitive layer 154 which travel in opposite directions thereacross. Charge carrier transit continues until the electric fields in X-ray sensitive layer 154 have been generally neutralized and the ASV, relative to GND, is reduced to a generally very low value. Elongate light source 80 (FIG. 2A) may be positioned above or below detection assembly 150 in accordance with embodiments of the invention described in FIG. 2A.

In accordance with an alternate embodiment of the present invention, the step of charge neutralization is carried out using both charge injector 161 and elongate light source 80 (FIG. 2A), activated sequentially or concurrently, with the elongate light beam 176 being projected onto X-ray sensitive material 154 at regions at which charge injection is taking place.

The step of neutralizing may be carried out as part of a standard imaging cycle or alternatively may be carried out periodically, e.g. prior to a period when the detection assembly is expected to remain idle, thereby reducing the electrical stress across X-ray sensitive layer 154 during non-use.

Figure 10:
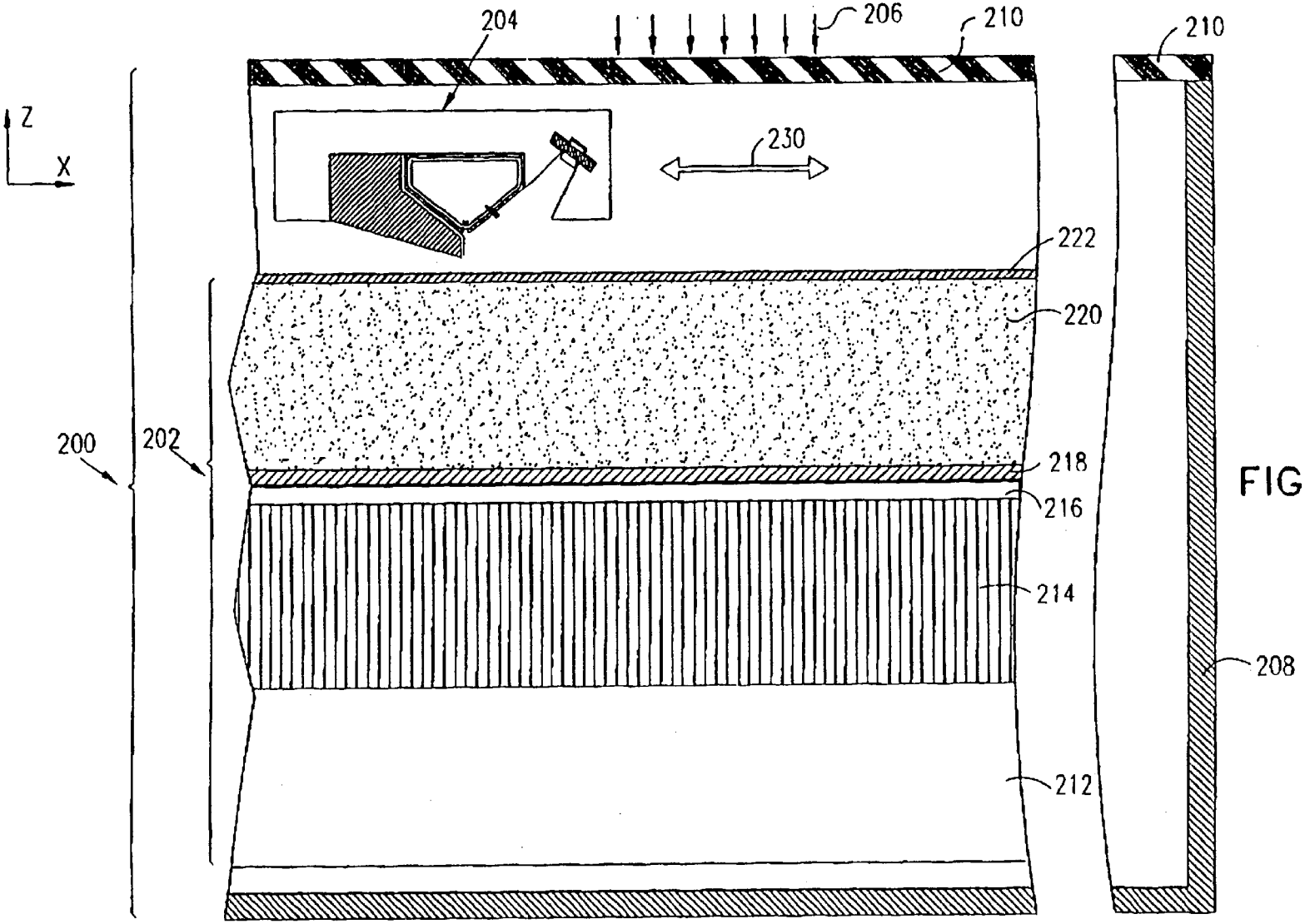
FIG. 10 is a sectional illustration taken along lines 2A—2A of FIG. 1A, illustrating an alternate embodiment of an x-ray image detection module which may serve as the x-ray detection module of FIGS. 1A–1B.

Reference is now made to FIG. 10 which is a cross-sectional view of an image detection module 200, constructed and operative in accordance with an alternative embodiment of the present invention. It is appreciated that image detection module 200 may serve as image detection module 26 in the embodiments of FIGS. 1A–1B.

Image detection module 200 includes a detection assembly 202 and an elongate scanner 204. The detection assembly 202, which is exposed to imagewise incident radiation 206 typically representing an X-ray image of a patient, is preferably enclosed by a housing 208 having an upper X-ray permeable cover 210.

Detection assembly 202 preferably comprises a layered stack including (from bottom to top) a support substrate 212, a scintillation layer 214 formed onto and overlying the support substrate 212, an optically transparent dielectric layer 216 overlying the scintillation layer 214, an optically transparent conductive electrode array 218, a photoelectric conversion layer 220 and preferably an overlying dielectric layer 222.

In accordance with one embodiment of the present invention, a very thin blocking layer (not shown), typically of sub-micron thickness, is disposed at the interface between the photoelectric conversion layer 220 and the underlying optically transparent conductive electrode array 218.

Support substrate 212 provides mechanical support and dimensional stability for detection assembly 202 and may serve as a base upon which layers 214–222 are formed. Preferably, support substrate 212 is a vacuum compatible panel, several millimeters thick (approximately 1 mm–5 mm), having a flat, uniform, smooth top surface. Examples of suitable materials for support substrate 212 are glass, metal and ceramics which preferably have a vacuum compatible, optical radiation absorbing top coating.

Further in accordance with alternative embodiments of the present invention, support substrate 202 and overlying layers 214–222 may be non-planar, e.g. parabolic or cylindrical, to provide alternative detection assembly geometries.

Scintillation layer 214, which emits optical photons in response to the absorption of x-ray radiation, is typically cesium iodide doped with thallium or cesium iodide doped with sodium. Cesium iodide is typically deposited by evaporation to form a structure of needles which are several microns in diameter and several hundred microns long (the thickness of scintillation layer 214). This aspect ratio between the needle length (relatively long) and diameter (relatively short) provides optical radiation guiding from the bottom of the scintillator towards the upper layers of detection assembly 202, with reduced scatter, such that the emitted optical radiation is efficiently coupled into the photoelectric conversion layer 220, through the optically transparent dielectric layer 216 and the optically transparent conductive array 218.

Use of cesium iodide as a scintillator and deposition thereof in a needle-like structure is commonly known in the art.

Optically transparent dielectric layer 216 is preferably a relatively thin layer having a thickness in the range of 0.5 micron–5 micron which serves as a passivation layer for scintillation layer 214. In addition, optically transparent dielectric layer 216 provides electrical insulation for the optically transparent conductive electrode array 218 formed thereover. Optically transparent dielectric layer 216, may be formed by deposition of a suitable vacuum compatible material such as silicon nitride (SiN), silicon dioxide ($SiO_2$) or a combination thereof, on scintillation layer 214.

In accordance with a preferred embodiment of the present invention, optically transparent conductive electrode array 218 comprises a plurality of strip electrodes (not shown) which are preferably planar, elongate and parallel and which preferably end in fan-out regions (not shown) as described hereinabove with particular reference to FIGS. 2A–2B.

Optically transparent conductive electrode array 218 is preferably formed using photolithography and wet or dry microetching techniques to pattern and segment a generally continuous conductive film which is deposited on optically transparent dielectric layer 216. Alternatively, patterning and segmentation of the conductive film may be carried out using thermal ablation techniques (e.g. laser "dry" etching).

In order to efficiently pattern conductive film using the abovementioned techniques, it is appreciated that optically transparent dielectric layer 216 must effectively passivate scintillation layer 214.

The conductive film is preferably a transparent indium tin oxide (ITO) coating, with a thickness typically in the range of 1,000–10,000 angstroms.

Typically, readout electronics, which are described hereinbelow with reference to FIGS. 11–13, are preferably fixed or removably coupled to connection fan-out regions (not shown) of optically transparent conductive electrode array 218. The connection regions, which may be at one or more non-active locations of detection assembly 202 and which typically are not directly exposed to x-ray radiation, are provided in order to enable use of standard electronic connection technologies. For removable high density connections, zebra silicon rubber connectors are preferable. Preferably, non-active locations are located at the periphery of detection assembly 202.

Photoelectric conversion layer 220, which overlies conductive electrode array 218, preferably exhibits optical radiation photoconductivity—i.e. following exposure to optical photons emerging from scintillation layer 214, the material generates a suitable number of extractable mobile electron hole pairs. In addition to its optical radiation sensitivity, photoelectric conversion layer 220 may exhibit x-ray radiation photoconductivity as well. Typical thickness of photoelectric conversion layer 220 is in the range of 10–60 microns.

Preferably, photoelectric conversion layer 220 exhibits generally high dark resistivity, allowing an electric field to be maintained thereacross for a period of time required for X-ray exposure and image reading. The density of charge carrier trap sites in photoelectric conversion layer 220 is preferably low.

Preferably, and in order to provide an efficient overall conversion of x-ray radiation to charge carriers, photoelectric conversion layer 220 is selected such that it is highly sensitive to optical radiation wavelengths at the emission maximum of scintillation layer 214. For example, if scintillation layer 214 is cesium iodide doped with thallium, the maximum emission spectrum occurs at 550 nm. In this case a suitable material for photoelectric conversion layer 220 is amorphous selenium and selenium alloys.

Among other suitable materials for photoelectric conversion layer 220 are amorphous silicon (a-Si) and organic photoconductors comprising a submicron charge generation layer (CGL) and a much thicker charge transport layer (CTL) as well known in the art.

Dielectric layer 222, which overlies photoelectric conversion layer 220, preferably serves as a charge accepting surface. Dielectric layer 222, which is preferably highly uniform, is typically several microns thick with a volume resistivity which is greater than $10^{13}$ ohms/centimeter.

Moreover, and depending upon its material properties, dielectric layer 222 may serve as an optical filter which absorbs a selected radiation spectrum, e.g. undesired UV and selected visible radiation, preventing penetration of said selected radiation into photoelectric conversion layer 220 from the top of detection assembly 202. Alternately or additionally, dielectric layer 222 may further serve as a physical and/or chemical passivation layer for photoelectric conversion layer 220.

It is appreciated that dielectric layer 222 may comprise a multi-layer dielectric thin film structure with different layers providing different functionality as described above.

In accordance with an alternate embodiment of the present invention, an outer surface of photoelectric conversion layer 220 serves as a charge accepting surface instead of dielectric layer 222, thus obviating the need for dielectric layer 222.

FIG. 10 also shows elongate scanner 204 which may be elongate scanner 52 (FIGS. 2A–2B). Elongate scanner 204 sweeps along an axis 230 over the detection assembly 202 using conventional electro-mechanical means (not shown) to provide linear motion thereof along conventional linear guides (not shown). Elongate scanner 204 is constructed and operated as described hereinabove with particular reference to FIGS. 2A–3B.

It should be appreciated that the operation of detection assembly 202 is generally as described hereinabove for detection assembly 150 (FIGS. 7A–7D). Specifically, it may be noted that the steps of sensitizing (FIG. 7A), image reading (FIG. 7C) and erasing (FIG. 7D) are essentially the same as described above with the photoelectric conversion layer 220 replacing the x-ray sensitive layer 154 (FIGS. 7A, 7C, 7D).

For the embodiment described in FIG. 10., the step of exposure and imaging radiation absorption is different than as described with reference to FIG. 7B. According to the present embodiment, a combination of photoelectric conversion layer 220 and scintillation layer 212 functionally replaces the x-ray sensitive layer 154 (FIG. 7B) with the imaging radiation absorbed mainly by scintillation layer 212 and partially by photoelectric conversion layer 220.

Generation of charge carriers occurs in photoelectric conversion layer 220 in response both to "direct" interaction with x-ray radiation photons as described with respect to FIG. 7B and "indirectly" through interaction with optical photons emitted and directed upwards by the scintillation layer 212 following interaction therein with x-ray photons.

The proportion of x-ray radiation absorbed by each layer, and thus the amount of charge carriers generated "directly" and those generated "indirectly", is determined by the x-ray sensitivity and thickness of photoelectric conversion layer 220 and the x-ray sensitivity and thickness of the scintillation layer 212.

It is appreciated that, to enable x-ray photons to pass efficiently to scintillation layer 212, optically transparent conductive array 218 and optically transparent dielectric layer 216 are preferably highly permeable to x-ray radiation.

Similarly, to enable efficient optical coupling of scintillation radiation to photoelectric conversion layer 220, optically transparent conductive array 218 and optically transparent dielectric layer 216 are preferably as thin as possible providing high transmission and low reflection optical radiation.

Reference is now made to FIGS. 11–13 which illustrate readout electronics 300 which may be used in accordance with an X-ray image detection assembly as described hereinabove. FIGS. 11 and 12 are block diagrams of readout electronics 300 connected to conductive electrodes 301 forming part of a detection assembly such as detection assembly 50 or 150 or 202 as described hereinabove.

Also shown schematically is an elongate scanner 308 which generally transverses conductive electrodes 301 and which may be of the type described hereinabove. A charge injector (not shown) of elongate scanner 308 is activated by a signal CI to perform image reading as described hereinabove and hereinbelow. In the example described hereinbelow, the charge injector is operated continuously.

It is appreciated that conductive electrodes 301 may serve as the strip electrodes 72 of conductive electrode array 62 (FIGS. 3A and 2B) as the conductive electrodes of conductive electrode array 158 (FIGS. 7A–7D) or as the conductive electrodes of conductive electrode array 218 (FIG. 10).

FIG. 13 is a timing diagram of the signals associated with readout electronics 300. These signals may be supplied by a system controller (not shown).

It is appreciated that the circuits described herein represent one non-limiting embodiment of readout electronics 300. Alternative circuit embodiments capable of high speed, parallel reading of small signals with minimal noise may be used as an alternative to the circuits described in connection with FIGS. 11 and 12.

Readout electronics 300, which may serve as readout electronics 164 of FIG. 7C, are used to read a charge pattern representing an X-ray image retained by an X-ray image detector following exposure to X-ray radiation as described hereinabove.

Typically, a charge pattern to be read comprises an m×n pixel matrix, where m is a fixed number corresponding to the number of conductive electrodes 301 and n is determined by the read sampling frequency. For example, it is a particular feature of the present invention that reading of an 14"×17" X-ray image comprising as many as 30,000,000 pixels can be accomplished in seconds and preferably in less than one second.

Charge patterns are read by measuring the injection current which flows during a read cycle between conductive electrodes 301 and ground 310.

Readout electronics 300 preferably includes a plurality of multi-channel analog circuits 312 and a plurality of multi-channel digital circuits 314. Typically the number of channels of each of multi-channel circuits 312 and 314 is equal to the number of conductive electrodes 301, with each electrode being connected to a single channel. Alternately, several electrodes 301 may be connected to a single channel reducing the spatial resolution in one dimension.

Typically, each input channel of multi-channel analog circuit 312 includes a signal reader 316. Signal reader 316 measures input current and provides a pulse-width modulated (PWM) output signal, corresponding to the current integrated over a predefined period of time T, associated with the read sampling frequency, and corresponding to the total charge flow. Signal reader 316 is described hereinbelow with reference to FIG. 12.

The PWM signal provided by signal reader 316 is input to a corresponding converter 318 forming part of multi-channel digital circuit 314. Converter 318 is described hereinbelow with reference to FIG. 12.

Converter 318 converts the PWM signal to multi-bit digital data which is output to a data bus 320, with synchronization being provided by a multiplexer 322.

Thus, readout electronics 300 provides parallel conversion from small-signal analog information to multi-bit serial digital data.

According to a preferred embodiment of the present invention illustrated in FIG. 11, each multi-channel analog circuit 312 is realized in an individual Application Specific Integrated Circuit (ASIC) and each multi-channel digital circuit 314 is realized in an individual digital ASIC.

In accordance with an alternative embodiment of the invention, the analog and digital ASICS may be integrated into a single ASIC. However, in order to enhance the signal to noise ratio of readout electronics 300, it is preferable to provide distinct analog ASICs and digital ASICs. Preferably, and in order to effectively achieve the parallel to serial data conversion, the digital ASICs are cascadable.

Multi-channel analog circuit 312 and multi-channel digital circuit 314 may be more fully understood by reference to FIG. 12 which schematically illustrates the operation of signal reader 316 and converter 318 for a single channel.

A transimpedance amplifier 324 serves as an impedance buffer for conductive electrodes 301 and also separates the injection and induction currents, when a hardware-based methodology is used as described hereinabove. Injection current, as described hereinabove, flows through a first input stage 325 of transimpedance amplifier 324 to GND and is converted to a corresponding amplified voltage signal.

Induction current, as described hereinabove, flows through a second input stage 326 of the transimpedance amplifier 324 to gnd, and is not measured.

It should be noted that input stages 325 and 326 have independent biasing voltages, with the biasing voltage set with respect to GND being applied to input stage 325 and the rest of the readout electronics 300 and the biasing voltage set with respect to gnd being applied to input stage 326 only.

The amplified voltage signal, corresponding to the injection current, is filtered by a filter 327 which limits the bandwidth of signal detection, thus rejecting a high level of noise while preserving the signal information, thereby improving the signal-to-noise ratio.

The filtered signals are integrated over time by an integrator 328 to provide a value which corresponds to the total injection current flowing through a channel during time T which is associated with the read sampling frequency. Time T is established by consecutive reset signals R supplied to integrator 328.

Integrating the filtered signals at integrator 328 allows accumulation of momentary signal values, thus enhancing the read signal, while random noise interference is averaged out. This further improves the signal-to-noise ratio.

Upon activation by means of a sample actuation signal S, the value at the output of integrator 328 is sampled by a sample and hold circuit 332. The resulting sampled value is then applied to a comparator 334 for comparison to a RAMP signal. As a result of the comparison, comparator 334 outputs a pulse width modulated signal PWM corresponding to the level of the sampled value.

Converter 318 receives the PWM signal and converts it into digital data with a predefined depth (e.g. 8–14-bit). The digital data value is output to data bus 320. Typically, each converter 318 includes a counter 336 and a data latch 338.

During each read time cycle $T_n$, m pixels are read in parallel, typically one pixel per conductive electrode 301, typically corresponding to one raster line of the charge pattern to be read.

Read cycle $T_n$, as shown in FIG. 13, typically has a duration which is greater than 100 microseconds.

At the beginning of the cycle, a timing signal E enables operation of comparator 334 and counter 336 and the RAMP signal starts ramping up from a minimal value towards its maximum value, corresponding to the entire signal range of the readout electronics 300.

Comparator 334 outputs a "high" PWM signal and counter 336 counts up the clock pulses of signal CC. When the RAMP signal becomes equal to the sampled signal value, the PWM signal drops to a "low" state and counter 336 ceases counting.

When the PWM signal is "low", counter 336 maintains a count value (8–14 bit) corresponding to the duration of the "high" PWM signal.

Towards the end of cycle $T_n$, Sample actuation signal S causes sample and hold circuit 332 to sample the value of a pixel n and causes data latch 338 to sample and store the count value of counter 336 for a pixel n−1.

Enable signal E is then disabled and RAMP signal drops to its minimum value in preparation for a subsequent comparison.

Following activation by sample actuation signal S, reset signal R is given to counter 336 and integrator 328, resetting them in preparation for subsequent analog signal sampling and digial conversion.

Typically, a plurality of multi-channel digital circuits 314 are cascaded together. Each multi-channel digital circuit 314 is selected by a chip select input signal CSI to sequentially transfer data loaded in data latches 338 to data bus 320, using clocks provided by shift clock signal SC (FIG. 11).

When the last data latch 338 has transferred its data to data bus 320, a chip select output signal CSO is provided by multi-channel digital circuit 314. The CSO serves as the CSI signal for a subsequent multi-channel digital circuit 314 in the cascade.

The chip selection process continues until each multi-channel digital circuit 314 in the cascade has sequentially output the data stored in its data latches 338 to data bus 320.

Each complete CSI/CSO cycle over the cascade, provides multi-bit digital data on data bus 320 sequentially from typically m channels, thus representing one raster line of an image to be read.

The CSI signal is received by the first multi-channel digital circuit 314 in the cascade immediately after sample actuation signal S has enabled the transfer of data from each counter 336 to each data latch 338.

Thus, during each cycle $T_n$ the following occurs at each of the typically m channels:

The injection current signal for pixel n is integrated and sampled.

Sampled analog signal for pixel n−1 is converted to digital data and stored.

Stored digital data for pixel n−2 is sequentially transferred to data bus 320 from each of the m channels.

It will be appreciated by persons skilled in the art that the present invention is not limited by what has been described above. The scope of the present invention includes both combinations and sub-combinations of the various features described hereinabove as well as modifications and additions thereto which would occur to a person skilled in the art upon reading the foregoing disclosure and which are not in the prior art.

What is claimed is:

1. A radiation detection module comprising:

an ionizing radiation sensitive multi-layer structure having a charge pattern accepting and retaining outer surface and comprising a conductive layer, said ionizing radiation sensitive multi-layer structure being operative such that imagewise ionizing radiation impinging on said ionizing radiation sensitive multi-layer structure causes a charge distribution, representing said imagewise ionizing radiation, to be formed in said conductive layer; and readout electronics coupled to said conductive layer to detect the charge distribution formed in said conductive layer.

2. A radiation detection module according to claim 1 wherein the ionizing radiation sensitive multi-layer structure comprises a layered stack having the following order:

a dielectric layer;

said conductive layer; and an ionizing radiation sensitive layer;

wherein the charge pattern accepting and retaining outer surface is an outer surface of said ionizing radiation sensitive layer.

3. A radiation detection module according to claim 1 wherein the ionizing radiation sensitive multi-layer structure comprises a layered stack having the following order:

a first dielectric layer;

said conductive layer; and an ionizing radiation sensitive layer; and a second dielectric layer;

wherein the charge pattern accepting and retaining outer surface is an outer surface of said second dielectric layer.

4. A radiation detection module according to claim 3 wherein said second dielectric layer serves as an optical filter tailoring a radiation spectrum of non-ionizing radiation penetrating into the ionizing radiation sensitive layer.

5. A radiation detection module according to claim 2 wherein the ionizing radiation sensitive layer is at least one of amorphous selenium and a selenium alloy.

6. A radiation detection module according to claim 2 wherein the ionizing radiation sensitive layer is a material selected from the group consisting of lead oxide, thallium bromide, cadmium telluride, cadmium zinc telluride, cadmium sulfide, and mercury iodide.

7. A radiation detection module according to claim 3 wherein the ionizing radiation sensitive layer is at least one of amorphous selenium and a selenium alloy.

8. A radiation detection module according to claim 3 wherein the ionizing radiation sensitive layer is a material selected from the group consisting of lead oxide, thallium bromide, cadmium telluride, cadmium zinc telluride, cadmium sulfide, and mercury iodide.

9. A radiation detection module according to claim 1 wherein the ionizing radiation sensitive multi-layer:

a scintillation layer;

a dielectric layer;

said conductive layer; and a photoelectric conversion layer;

wherein the charge pattern accepting and retaining outer surface is an outer surface of said photoelectric conversion layer and wherein the conductive layer and the dielectric layer are generally transparent to optical radiation and permeable to ionizing radiation.

10. A radiation detection module according to claim 1 wherein the ionizing radiation sensitive multi-layer:

a scintillation layer;

a first dielectric layer;

said conductive layer;

a photoelectric conversion layer; and a second dielectric layer;

and wherein the charge pattern accepting and retaining outer surface is an outer surface of said second dielectric layer and wherein the conductive layer and the first dielectric layer are generally transparent to optical radiation and permeable to ionizing radiation.

11. A radiation detection module according to claim 10 wherein said second dielectric layer serves as an optical filter tailoring a radiation spectrum of non-ionizing radiation penetrating into the photoelectric conversion layer.

12. A radiation detection module according to claim 9 wherein the photoelectric conversion layer is at least one of amorphous selenium, a selenium alloy and amorphous silicon.

13. A radiation detection module according to claim 9 wherein the photoelectric conversion layer is an organic photoconductor.

14. A radiation detection module according to claim 10 wherein the photoelectric conversion layer is at least one of amorphous selenium, a selenium alloy and amorphous silicon.

15. A radiation detection module according to claim 10 wherein the photoelectric conversion layer is an organic photoconductor.

16. A radiation detection module according to claim 9 wherein the scintillation layer is at least one of cesium iodide and a doped version thereof.

17. A radiation detection module according to claim 10 wherein the scintillation layer is at least one of cesium iodide and a doped version thereof.

18. A radiation detection module according to claim 1 and also comprising a charge injector which scans the ionizing radiation sensitive multi-layer structure and which provides injection of charges on the charge pattern accepting and retaining outer surface of said ionizing radiation sensitive multi-layer structure.

19. A radiation detection module according to claim 18 and also comprising an electrostatic barrier which spatially tailors said injection of charges.

20. A radiation detection module according to claim 18 and wherein said injection of charges generates in said readout electronics measurable currents representing the charge distribution formed in the conductive layer.

21. A radiation detection module according to claim 18 where the charge injector comprises:

an embedded electrode;

an exposed screen electrode in proximity to the embedded electrode, said embedded electrode and said exposed screen electrode being separated at a region of proximity by a thin dielectric layer, a generator which provides an AC voltage between the embedded electrode and the screen electrode causing air discharge at said region of proximity, thus generating positive and negative charges; and a voltage source which provides a DC bias voltage in the range of several hundred to several thousand volts to the screen electrode, providing the acceleration force for charge injection.

22. A radiation detection module according to claim 21 wherein the DC bias voltage can be selected such that the DC component associated with the Fourier spectrum of spatial frequencies of an image to be detected is factored out.

23. A radiation detection module according to claim 20 and wherein the measurable currents comprise an induction component and an injection component.

24. A radiation detection module according to claim 23 and also comprising hardware for disinguishing between said induction component and said injection component.

25. A radiation detection module according to claim 23 and also comprising software for distinguishing between said induction component and said injection component.

26. A radiation detection module according to claim 1 and wherein the readout electronics are permanently coupled to the conductive layer.

27. A radiation detection module according to claim 1 and wherein the readout electronics are removably coupled to the conductive layer.

28. A radiation detection module according to claim 1 and wherein the ionizing radiation is x-ray radiation.

29. An addressable array of radiation detection elements comprising:

a radiation sensitive layered stack;

a plurality of electronically addressable conductive columns associated with the radiation sensitive layered stack;

readout electronics coupled to said plurality of electronically addressable conductive columns; and a charge injector, which scans the conductive columns, providing sequential row addressing of the array of radiation detection elements.

30. An addressable array of radiation detection elements according to claim 29 wherein the radiation is ionizing radiation.

31. An addressable array of radiation detection elements according to claim 30 wherein the ionizing radiation is x-ray radiation.

32. An addressable array of radiation detection elements according to claim 29 wherein the radiation sensitive layered stack includes at least one ionizing radiation sensitive layer.

33. An addressable array of radiation detection elements according to claim 32 wherein the at least one ionizing radiation sensitive layer converts ionizing radiation to charge carriers.

34. An addressable array of radiation detection elements according to claim 32 wherein the at least one ionizing radiation sensitive layer converts ionizing radiation to optical radiation.

35. An addressable array of radiation detection elements according to claim 34 and also including a photoelectric conversion layer which converts optical radiation to charge carriers.

36. An addressable array of radiation detection elements according to claim 32 wherein the at least one ionizing radiation sensitive layer is one of amorphous selenium and a selenium alloy.

37. An addressable array of radiation detection elements according to claim 34 wherein the at least one ionizing radiation sensitive layer is one of cesium iodide and a doped version thereof.

38. An addressable array of radiation detection elements according to claim 29 wherein the radiation sensitive layered stack includes a charge accepting outer surface.

39. An addressable array of radiation detection elements according to claim 38 wherein the charge accepting outer surface is a dielectric layer that also provides filtration of impinging optical radiation by selective radiation absorption.

40. An addressable array of radiation detection elements according to claim 29 and wherein the readout electronics are permanently coupled to the conductive columns.

41. An addressable array of radiation detection elements according to claim 29 and wherein the readout electronics are removably coupled to the conductive columns.

42. A module for detection of ionizing radiation images, the module comprising:

an ionizing radiation receiving substrate arranged to receive an ionizing radiation image, said substrate including at least one segmented layer, that is segmented in a single dimension along a single segmentation axis, and at least one non-segmented layer; and an elongate scanning charge injector operative in association with said ionizing radiation receiving substrate for scanning said substrate along a scanning axis which is generally perpendicular to said segmentation axis.

43. A method for radiation detection employing an addressable array of radiation detection elements comprising:

providing a radiation sensitive layered stack, a plurality of electronically addressable conductive columns associated with the radiation sensitive layered stack, and readout electronics coupled to said plurality of electronically addressable conductive columns; and employing a charge injector to scan the conductive columns, providing sequential row addressing of the array of radiation detection elements, thereby detecting said radiation via said readout electronics.

44. A method for radiation detection according to claim 43 wherein the detected radiation is ionizing radiation.

45. A method for radiation detection according to claim 44 wherein the ionizing radiation is x-ray radiation.

46. A method for radiation detection, the method comprising:

providing an ionizing radiation sensitive multi-layer structure having a charge pattern accepting and retaining outer surface and comprising a conductive layer coupled to readout electronics;

sensitizing said ionizing radiation sensitive multi-layer structure; and exposing said sensitized ionizing radiation sensitive multi-Layer structure to impinging ionizing radiation, thereby causing a readable charge distribution, representing said impinging ionizing radiation, to be formed in said conductive layer.

47. A method for radiation detection according to claim 46 and also comprising the step of detecting the charge distribution formed in said conductive layer via said readout electronics.

48. A method for radiation detection according to claim 47 and wherein the step of detecting the charge distribution includes causing a charge injector to scan over at least part of the charge pattern accepting and retaining outer surface.

* * * * *